US006045378A

United States Patent [19]

Follingstad

[11] Patent Number: 6,045,378

[45] **Date of Patent: *Apr. 4, 2000**

[54] SWITCHING COAXIAL JACK WITH IMPEDANCE MATCHING

[75] Inventor: Michael Jay Follingstad, Edina, Minn.

[73] Assignee: ADC Telecommunications, Inc., Minnetonka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/049,339

[22] Filed: Mar. 27, 1998

[51] Int. Cl.[7] ..... H01P 1/10

[52] U.S. Cl. ..... 439/188; 439/944

[58] Field of Search ..... 439/188, 944

[56] References Cited

U.S. PATENT DOCUMENTS

| | | | |
|---|---|---|---|
| 3,020,365 | 2/1962 | Neeman . | |
| 3,663,901 | 5/1972 | Forney, Jr. . | |
| 3,873,785 | 3/1975 | Lieberman . | |
| 4,264,115 | 4/1981 | Chow | 439/188 |
| 4,749,968 | 6/1988 | Burroughs . | |
| 5,246,378 | 9/1993 | Seiceanu . | |
| 5,280,254 | 1/1994 | Hunter et al. . | |
| 5,348,491 | 9/1994 | Louwagie et al. | 439/188 |
| 5,450,011 | 9/1995 | Boeijen et al. . | |
| 5,467,062 | 11/1995 | Burroughs . | |
| 5,475,394 | 12/1995 | Kohls et al. . | |
| 5,482,469 | 1/1996 | Seiceanu et al. . | |
| 5,585,768 | 12/1996 | Wei . | |
| 5,654,679 | 8/1997 | Mavretic et al. . | |
| 5,702,262 | 12/1997 | Brown et al. | 439/188 |
| 5,885,096 | 3/1999 | Ogren | 439/188 |

OTHER PUBLICATIONS

Article entitled "Avoiding the Pitfalls in Serial Digital Signal Distribution," from SMPTE Journal, Jan. 1993,–pp. 14–23.

Kings Electronics Co. Inc. Broadcast Video Products catalog, front cover page, pp. 1 and 7, and back cover page, dated 1991. (No month).

Photographs of a Kins Electronics Co. Inc. Video Jack Part No. 7400–1. (no date).

*Primary Examiner*—Khiem Nguyen
*Assistant Examiner*—J. F. Duverne
*Attorney, Agent, or Firm*—Merchant & Gould P.C.

[57] ABSTRACT

A switching coaxial jack (10') includes first and second parallel aligned electrically conductive coaxial center conductors. The center conductors are divided into front portions (42*a'*, 44*a'*) and rear portions (50*a'*, 52*a'*). The rear portions include movable springs to separate the rear portions from the front portions. A V-shaped switching spring (70') connects the rear portions. Levers (90', 92') push the rear portions out of connection with the switching spring and into connection with the front portions upon insertion of plugs into forward ports of the jack. Waveguides (210, 212, 214, 216, 218, 220, 222) provide matching of the impedance of the jack to the impedance of the telecommunications line.

21 Claims, 21 Drawing Sheets

SWITCHING COAXIAL JACK WITH IMPEDANCE MATCHING

I. BACKGROUND OF THE INVENTION

1. Field of the Invention

This invention pertains to coaxial jacks. More particularly, this invention pertains to a switching coaxial jack which is suitable for use in high frequency transmission rate applications.

2. Description of the Prior Art

Switching coaxial jacks are well known. An example of such is shown in U.S. Pat. Nos. 4,749,968 and 5,467,062 both to Burroughs. Another example is shown in U.S. Pat. No. 5,246,378 to Seiceanu.

Prior art switching coaxial jacks included two generally solid center conductors disposed in parallel alignment in a grounded electrically conductive housing. A switching assembly is positioned between the two center conductors.

The switching assembly includes a V-shaped spring with a first end biased against a first of the center conductors and with a second end biased against a second of the center conductors. As a result, the center conductors are in normal signal flow communication such that an electrical signal on one of the center conductors passes through the switching assembly to the other center conductor.

Such switching coaxial jacks would commonly be used in the telecommunications or video transmission industries. A rear end of the housing is provided with connectors for semi-permanent or permanent connection to coaxial cables. The front end of the center conductors are provided with jack ports for receiving a plug of predetermined dimensions. Normally, such switching jacks are operated without plugs inserted within the ports. Accordingly, a signal entering a center conductor from one of the rear connectors passes through the switching assembly and is transmitted out of the jack device through the other rear coaxial connector.

From time to time it is desirable to access the jack in order to tap off the signal or to input a new signal. To accomplish this, a jack plug with attached coaxial cable is inserted into one of the forward ports. Upon insertion of the jack plug into the forward port, the jack plug engages the V-shaped spring causing it to be moved away from the center conductor associated with the port into which the plug is inserted.

By causing the V-shaped spring to be moved away from the center conductor, the center conductor is no longer connected to the other center conductor such that the signal passes directly along the entire length of the center conductor and out the port. In addition to breaking the connection between the two center conductors of the jack, insertion of the plug also causes the other center conductor to be electrically connected to ground across a resistance so that the desired electrical impedance of the system is maintained.

With the structure thus described, normal signal flow from rear connector to rear connector passes through the V-shaped spring.

In the telecommunications industry, it is desired for the jack device to operate at 75 ohms impedance. There is a continuing need for jack devices having increased bandwidth while operating at or within an acceptable range of the desired 75 ohms impedance. For example, in the audio and video broadcasting industry there is a need for a video jack device which meets the 2.4 gigahertz frequency bandwidth required by High Definition Television (HDTV) networks. Frequencies for traditional television broadcasts are at about 4.2 megahertz, with newer or digital television broadcasts at about 750 megahertz.

II. SUMMARY OF THE INVENTION

According to a preferred embodiment of the present invention, a switching coaxial jack device is disclosed which has an electrically grounded housing and an electrically conductive coaxial center conductor extending from a rear portion to a front portion. A second coaxial center conductor is also included within the device. The rear portion of the first center conductor includes an electrically conductive movable portion which is movable between a first position and a second position. The movable portion is disposed in electrical contact with the second center conductor and electrically disconnected from the front portion of the first center conductor when the movable portion is in the first position. The movable portion is disposed in electrical contact with the front portion and electrically disconnected from the second center conductor when the movable portion is in the second position. One or more waveguides extend from the housing toward one or both of the first and second center conductors so as to provide impedance matching of the jack device to the impedance of the line (75 ohms). Preferably, the movable portion includes a leaf spring, and the one or more waveguides are in the form of a fin. Preferably, an actuator moves the movable portion from the first position to the second position when a coaxial cable is attached to the front portion of the first center conductor.

III. BRIEF DESCRIPTION OF THE DRAWINGS

IV. DESCRIPTION OF THE PREFERRED EMBODIMENTS

Referring now to the several drawing figures in which identical elements are numbered identically throughout, a description of the preferred embodiments of the present invention will now be provided.

Figure 25:
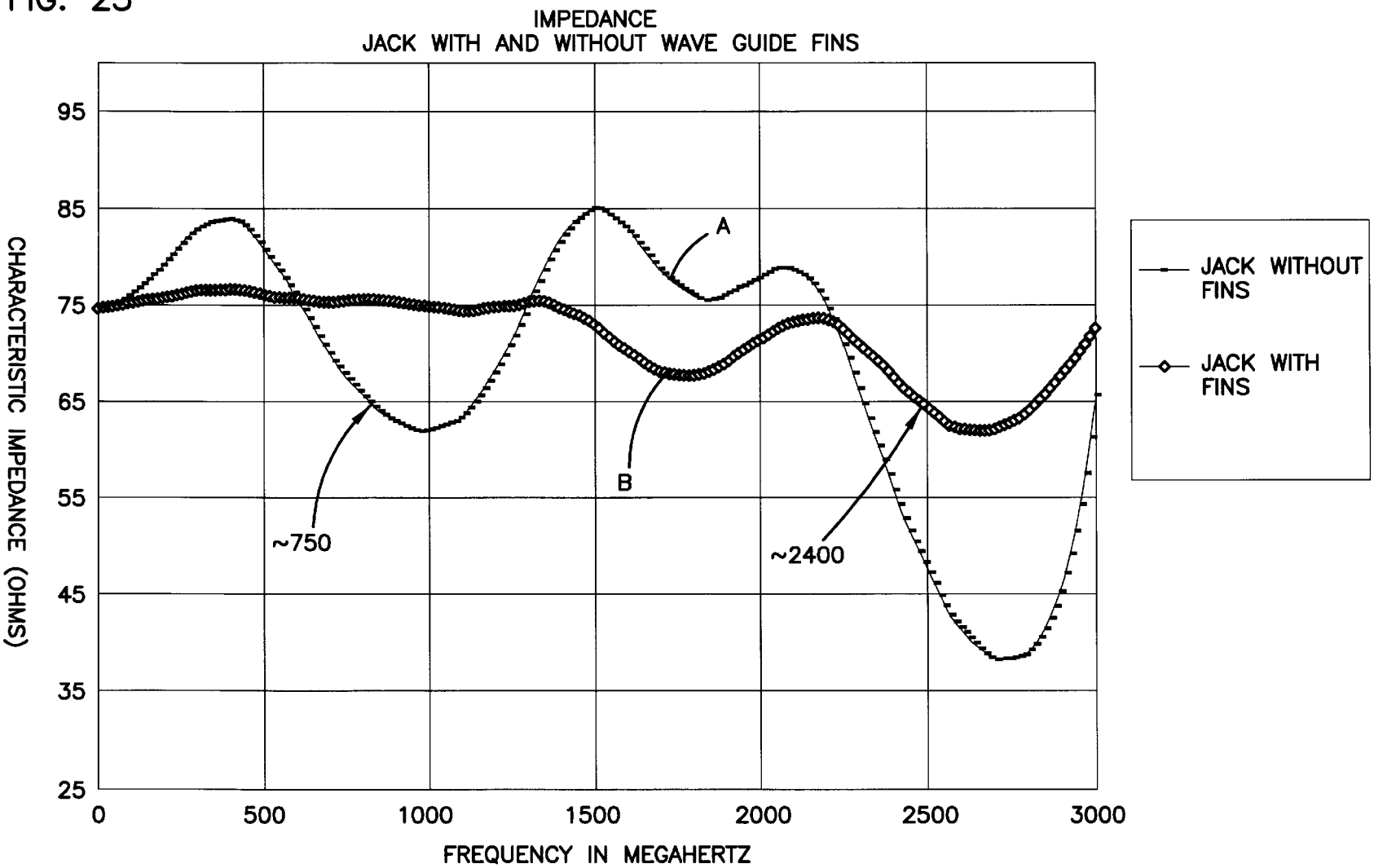
FIG. 25 is graph showing impedance versus frequency curves for the jack device of FIG. 1 (without waveguides) and the jack device of FIG. 16 (with waveguides)
Figure 26:
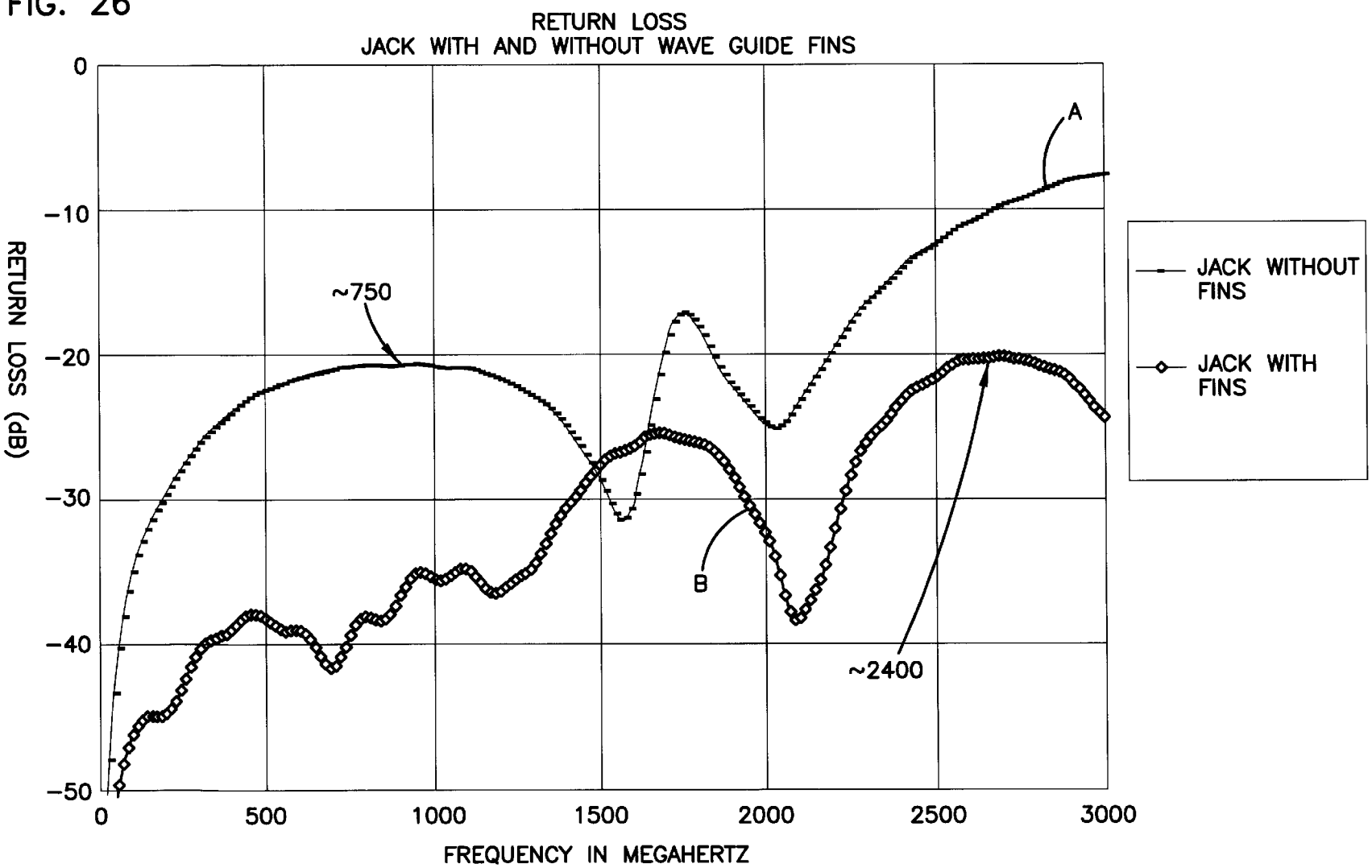
FIG. 26 is a graph showing return loss versus frequency curves for the jack device of FIG. 1 (without waveguides); and the jack device of FIG. 16 (with waveguides).

The present invention is a switching coaxial jack device including waveguides for impedance matching to enable use at high transmission frequencies, such as 2.4 gigahertz. The jack device includes a switch and waveguides associated with the switch to provide the impedance matching features. FIGS. 1–15 show a prior art jack device 10 with an exemplary switch but no waveguides. (See U.S. Pat. No. 5,885,096.) The jack device 10 can be modified with waveguides to improve bandwidth without losing the desired impedance characteristics. FIGS. 16–24 show a modified jack device 10' with a similar switch but with improved bandwidth over jack device 10. For identical or like parts in jack device 10' relative to jack device 10, an apostrophe is used in the reference numbers. The graphs of FIGS. 25 and 26 illustrate electrical performance differences between jack device 10 and jack device 10'.

The jack device 10 of FIGS. 1–15 includes a diecast, electrically conductive and electrically grounded housing 12. The housing 12 includes a front wall 14, rear wall 16, and top and bottom walls 18, 20. The jack device further includes a side wall 22 and a side cover 24 (shown only partially in FIG. 1 so that internal elements can be viewed). Front wall 14, rear wall 16, top wall 18, bottom wall 20 and side wall 22 form the main portion of housing 12, with side cover 24 separably mounted to the main housing.

The housing 12 includes an interior wall 26 which extends parallel to end walls 14, 16 and completely between the side walls 22, 24 and top and bottom walls 18, 20. The internal wall 26 cooperates with a wall segment 26*a* of cover 24 (FIG. 8) to divide an interior of the housing into a forward port chamber 28 and a rear switching chamber 30.

As shown in the figures, the forward wall 14 of housing 12 includes a first jack port 32 for receiving a plug 33 of predetermined dimensions. The forward wall 14 further includes a second jack port 34 for receiving such a plug.

Ports 32, 34 are in parallel alignment and each aligned with receptive first and second coaxial connectors 36, 38 disposed on the rear wall 16. Connectors 36, 38 may be any well known connector (such as so-called BNC connectors) or ports for semi-permanent or permanent attachment to coaxial cables. The ports 32, 34 include grounding clips 40 for engaging the ground sleeve of an inserted jack plug 33 and for electrically connecting the ground sleeve to the housing 12.

Axially aligned within each of ports 32, 34 are first and second, respectively, forward center conductors 42, 44 to receive a center pin of a jack plug 33 received within ports 32, 34, respectively. The center conductors 42, 44 are maintained in axial alignment within the ports 32, 34 by dielectric inserts 46, 48. The dielectric inserts 46, 48 are snugly received within pockets formed in the interior wall 26.

While inserts 46, 48 are shown as solid dielectric cylinders in FIGS. 1–8 for ease of illustration, alternative designs can be used. A preferred design will be later described with reference to FIGS. 9–15.

First and second rear center conductors 50, 52 are maintained coaxially aligned within rear connectors 36, 38 and maintained in axial alignment by reason of supporting dielectric inserts 54, 56 contained within the rear wall 16. First front and rear center conductors 42, 50 cooperate to define a complete first center conductor. Second front and rear center conductors 44, 52 cooperate to define a complete second center conductor.

It will be noted that the dielectric inserts 46, 48 resist dust flow through the ports 32, 34 and through wall 26 into chamber 30. Similarly, inserts 54, 56 resist dust flow through the connectors 36, 38 into chamber 30.

The first front center conductor 42 includes a spring portion 42*a* which extends from insert 46 into chamber 30. The first rear center conductor 50 includes a spring portion 50*a* which similarly extends from dielectric insert 54 into chamber 30. Similarly, each of the center conductors 44, 52 include spring portions 44*a*, 52*a* which extend from dielectric inserts 48, 56 into chamber 30. Spring portions 42*a*, 44*a*, 50*a*, and 52*a* are preferably constructed as flexible leaf springs.

A switch assembly 60 is contained within chamber 30. The switch assembly 60 includes a termination clip 62 having first and second termination contacts 64, 66 disposed adjacent free ends of springs 42*a*, 44*a*. Termination clip 62 is connected to the electrically grounded housing 12 across a resistor 68. The clip 62 is carried on a dielectric base 63 inserted within chamber 30. The base 63 includes dielectric projections 65 which support springs 42*a*, 50*a*, 44*a*, and 52*a*.

A V-shaped switching spring 70 is mounted within chamber 30 on a dielectric support post 72 which is integrally formed with and extends from base 63. The spring includes a first spring arm 70*a* and a second spring arm 70*b*. Spring arm 70*a* is biased toward electrical contact with termination contact 64. Spring arm 70*b* is biased toward electrical contact with second termination contact 66. Spring arms 70*a*, 70*b* are preferably constructed as leaf springs.

Figure 1:
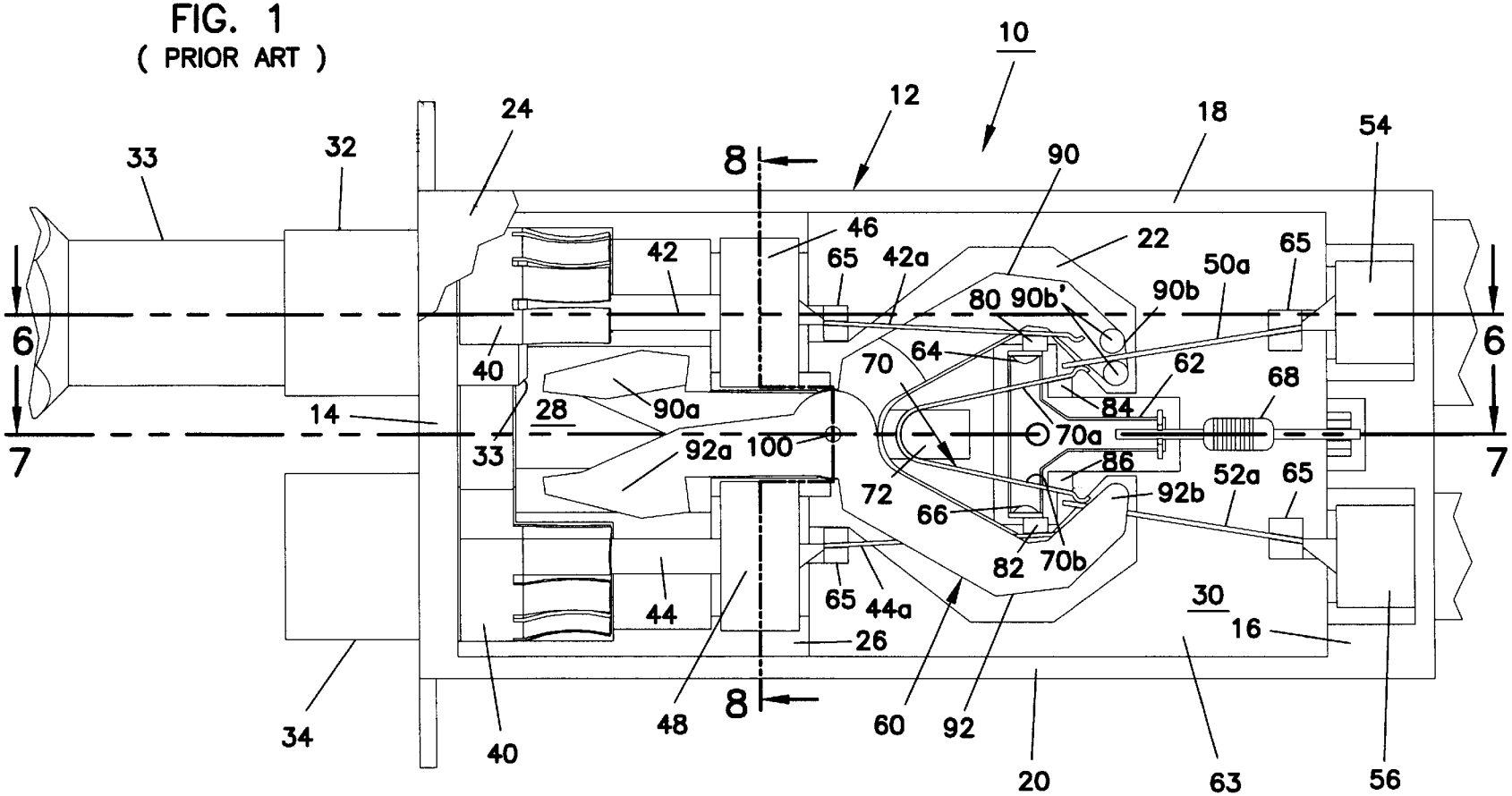
FIG. 1 ( PRIOR ART )
FIG. 1 is a side elevation view (with a portion of the cover removed) of a prior art switching coaxial jack device without waveguides shown with a plug partially inserted within a forward port of the jack device but with the plug not yet engaging a switching actuator.

The spring contacts 42*a*, 44*a* of the center conductors 42, 44 are biased toward the termination contacts 64, 66 respectively. To avoid direct connection of the springs 42*a*, 44*a* with the termination contacts 64, 66, dielectric spacers 80, 82 are positioned between the springs 42*a*, 44*a* and termination contacts 64, 66. Accordingly, in the absence of deflecting forces, the springs 42*a*, 44*a* abut against the dielectric spacers 80, 82 (FIG. 1). The spacers 80, 82 are formed with and project from base 63.

The springs 50*a*, 52*a* of rear center conductors 50, 52 are biased toward the ends 70*a*, 70*b* of the V-shaped switching spring 70. In the absence of any forces acting to displace the springs 50*a*, 52*a* (FIG. 1), the springs 50*a*, 52*a* have their free ends abutting the free ends of the springs 70*a*, 70*b*. Springs 50*a*, 52*a* urge springs 70*a*, 70*b* from termination contacts 64, 66. Dielectric support posts 84, 86 (projecting from base 63) prevent over deflection of the springs 70*a*, 70*b* and maintain spring pairs 50*a*, 70*a* and 52*a*, 70*b* in electrical contact.

In the drawings, springs 50*a*, 52*a* are shown biased against springs 70*a*, 70*b*. In addition to the natural bias of springs 50*a*, 52*a* (or as an alternative to such bias), supplemental springs (such as shown for jack device 10') could be provided (for example, extending between the sidewalls 18, 20 and levers 90, 92) to urge the levers 90, 92 to the position shown in FIG. 1.

Figure 4:
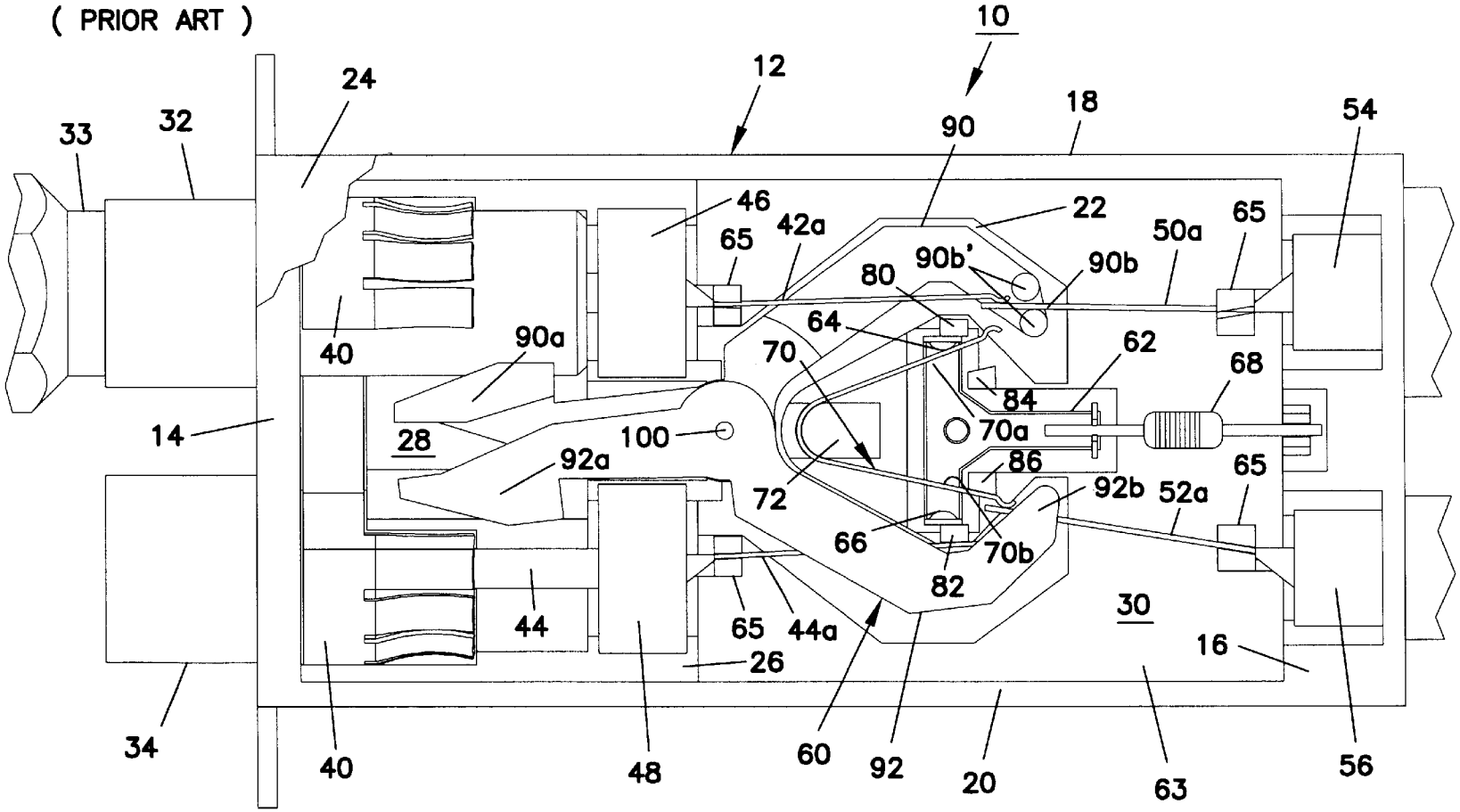
FIG. 4 ( PRIOR ART )
FIG. 4 is the view of FIGS. 1–3 with the plug shown fully inserted within the device.
Figure 5:
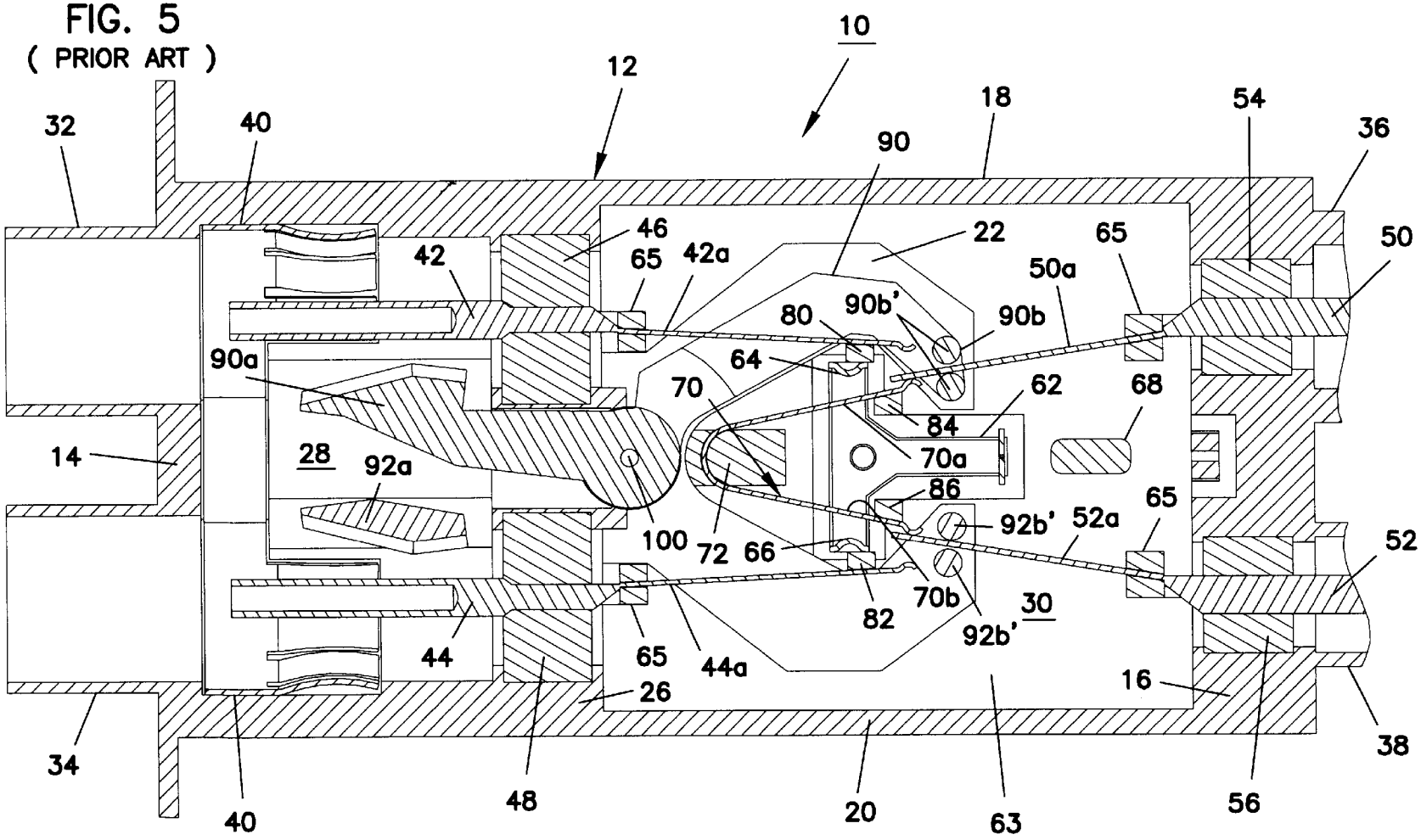
FIG. 5 ( PRIOR ART )
FIG. 5 is a side sectional view of the jack device of FIG. 1 with no plug inserted into the device.
Figure 6:
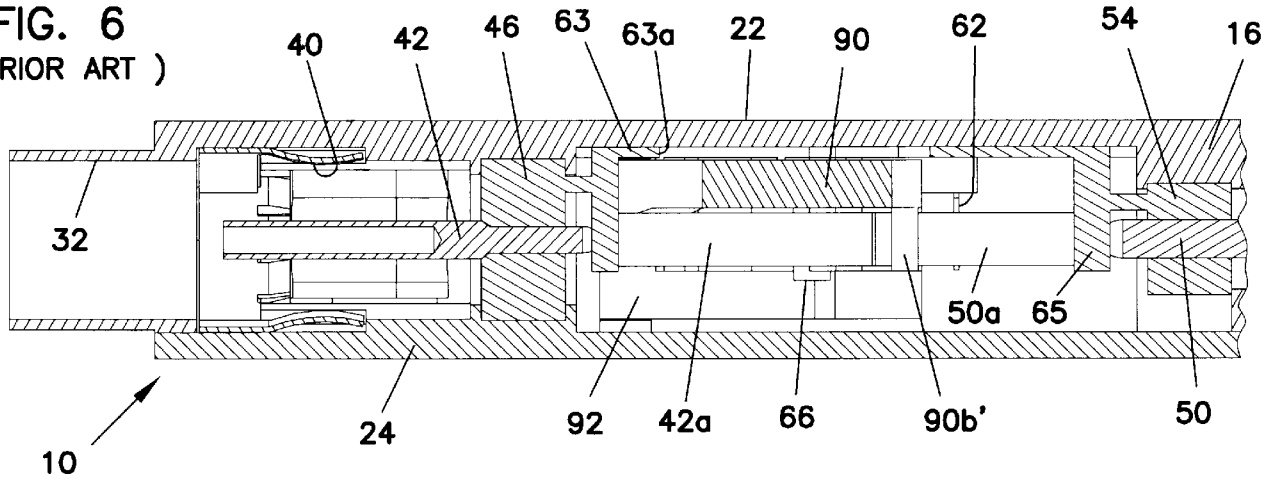
FIG. 6 ( PRIOR ART )
FIG. 6 is a view taken along line 6—6 of FIG. 1 (but with the plug removed for purpose of clarity)
Figure 7:
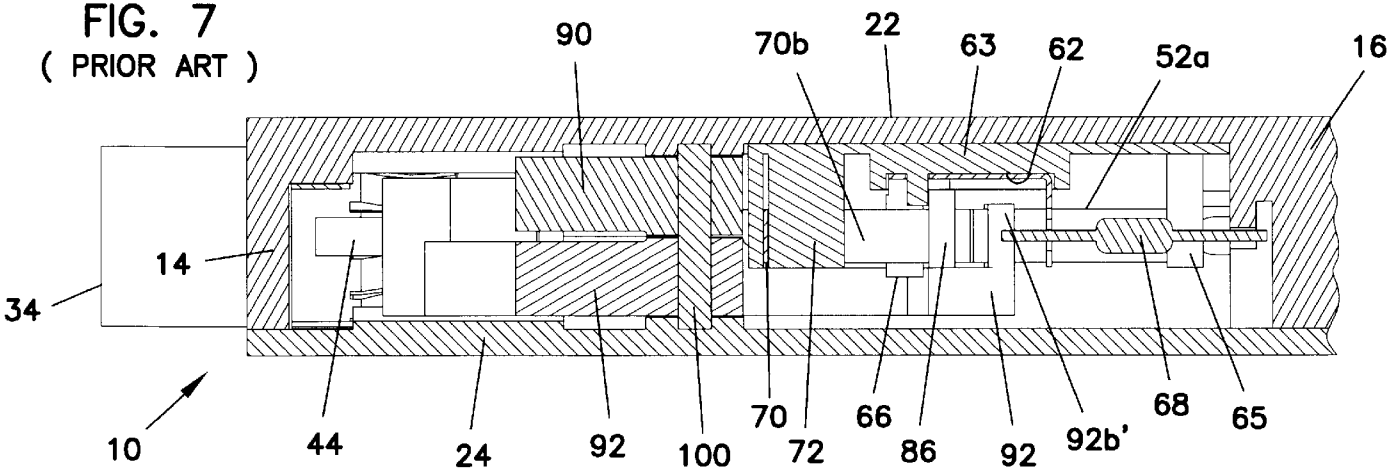
FIG. 7 ( PRIOR ART )
FIG. 7 is a view taken along line 7—7 of FIG. 1.
Figure 8:
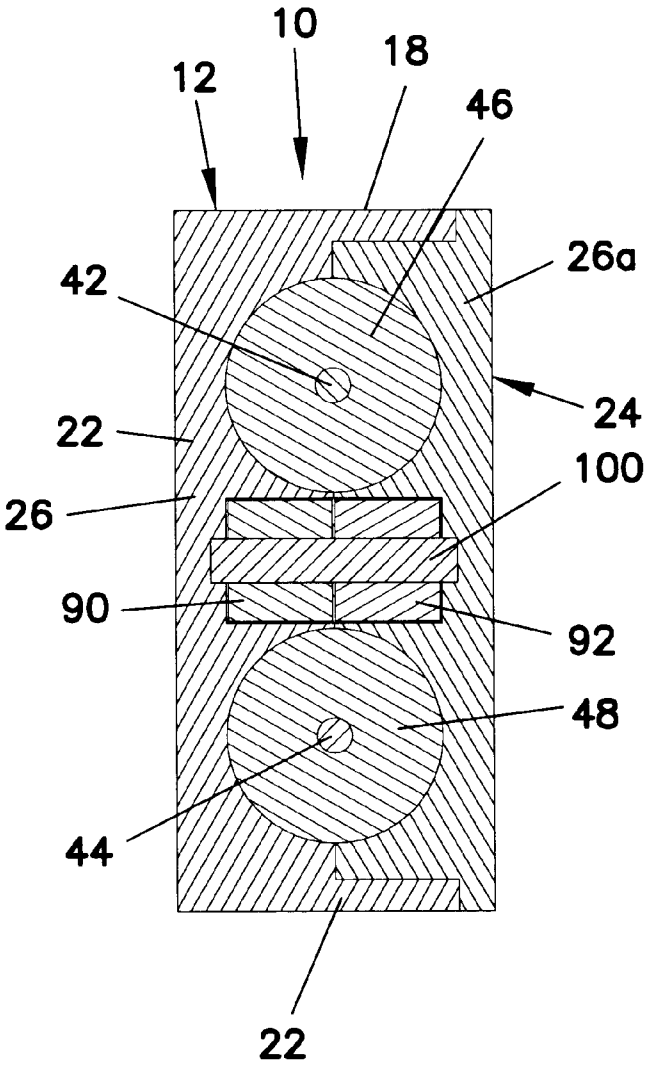
FIG. 8 ( PRIOR ART )
FIG. 8 is a view taken along line 8—8 of FIG. 1.

First and second dielectric levers 90, 92 are provided to act as actuators to move the springs 50*a*, 52*a* from first position shown in FIG. 1 to a second position (shown with respect to spring 50*a* in FIG. 4). The levers 90, 92 include cam ends 90*a*, 92*a* positioned adjacent ports 32, 34. The levers 90, 92 terminate at second ends 90*b*, 92*b* within chamber 30. A cutout 63*a* is formed in base 63 to provide clearance for movement of lever 90.

The ends 90*b*, 92*b* are provided with narrowly spaced apart posts 90*b*', 92*b*'. The free ends of the springs 50*a*, 52*a* are received in the posts 90*b*', 92*b*' for reasons that will become apparent.

Each of the levers 90, 92 pivot around a common pivot pin 100. The pivot pin 100 is positioned within a central opening in the wall levers 90, 92 are sized to substantially fill the opening such th pass through the opening from chamber 28 into chamber 30. The cam surfaces 90*a*, 92*a* are positioned such that the levers are pivoted around pin 100 upon insertion of a plug 33 into ports 32, 34, respectively.

With the structure thus described, the operation of the jack of the present invention will now be described with initial reference to FIG. 1. In FIG. 1, the jack device 10 is shown with a plug partially inserted into port 32 but not yet engaging cam 90*a*. Accordingly, a signal flowing along center conductor 50 passes through spring arm 50*a* and into the V-shaped spring 70. The signal is then transmitted out spring arm 52*a* and center conductor 52. No portion of the signal passes through springs 42*a*, 44*a* or center conductors 42, 44 since the free ends of springs 42*a*, 44*a* are spaced from the movable springs 50*a*, 52*a*. In FIG. 1, springs 50*a*, 52*a* are shown in a first position where they are in contact with the V-shaped spring 70 (and hence, in electrical contact with each other) and electrically and physically disconnected from springs 42*a*, 44*a*.

Figure 2:
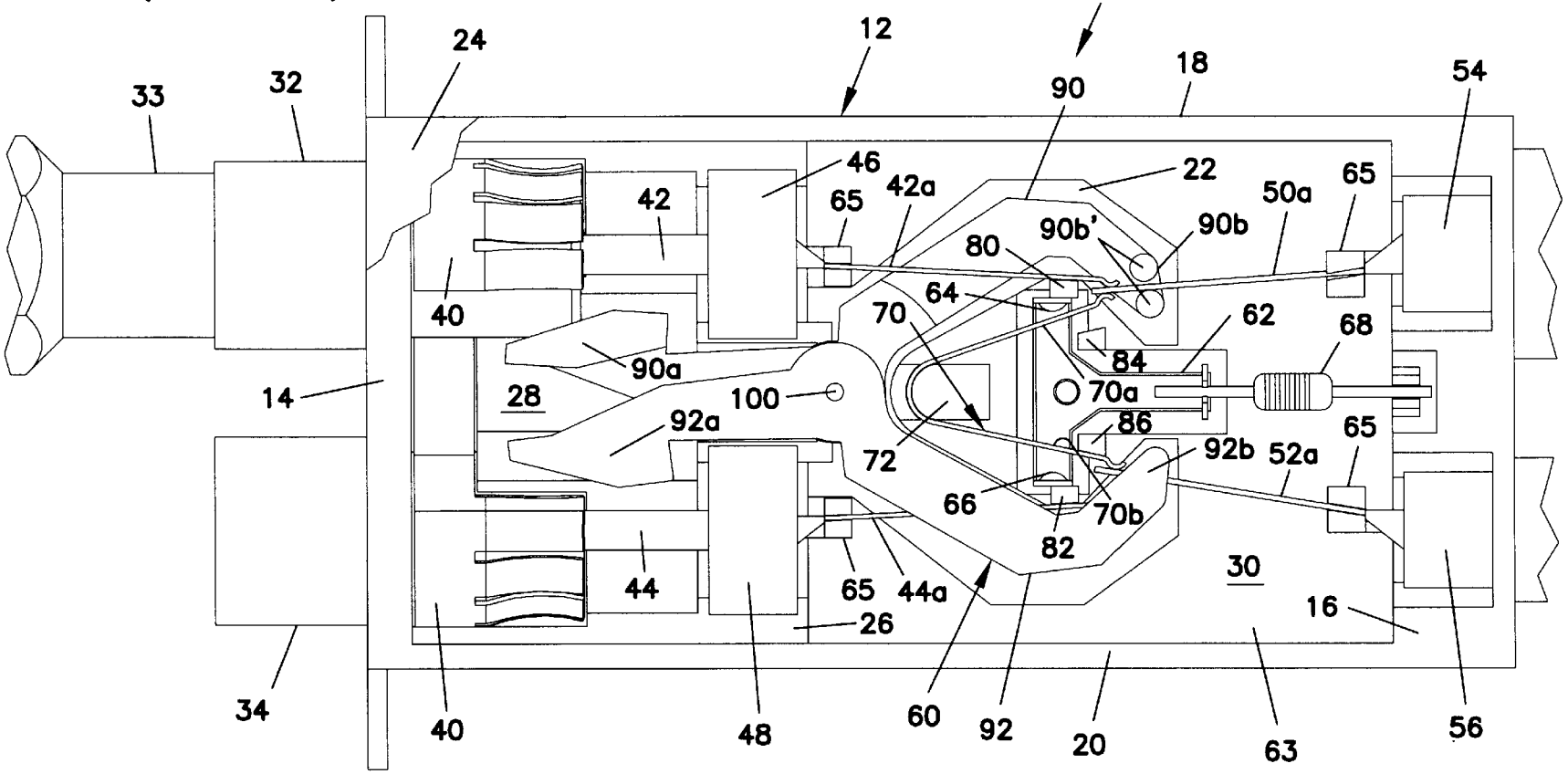
FIG. 2 ( PRIOR ART )
FIG. 2 is the view of FIG. 1 with the plug further inserted into a first port of the device.
Figure 3:
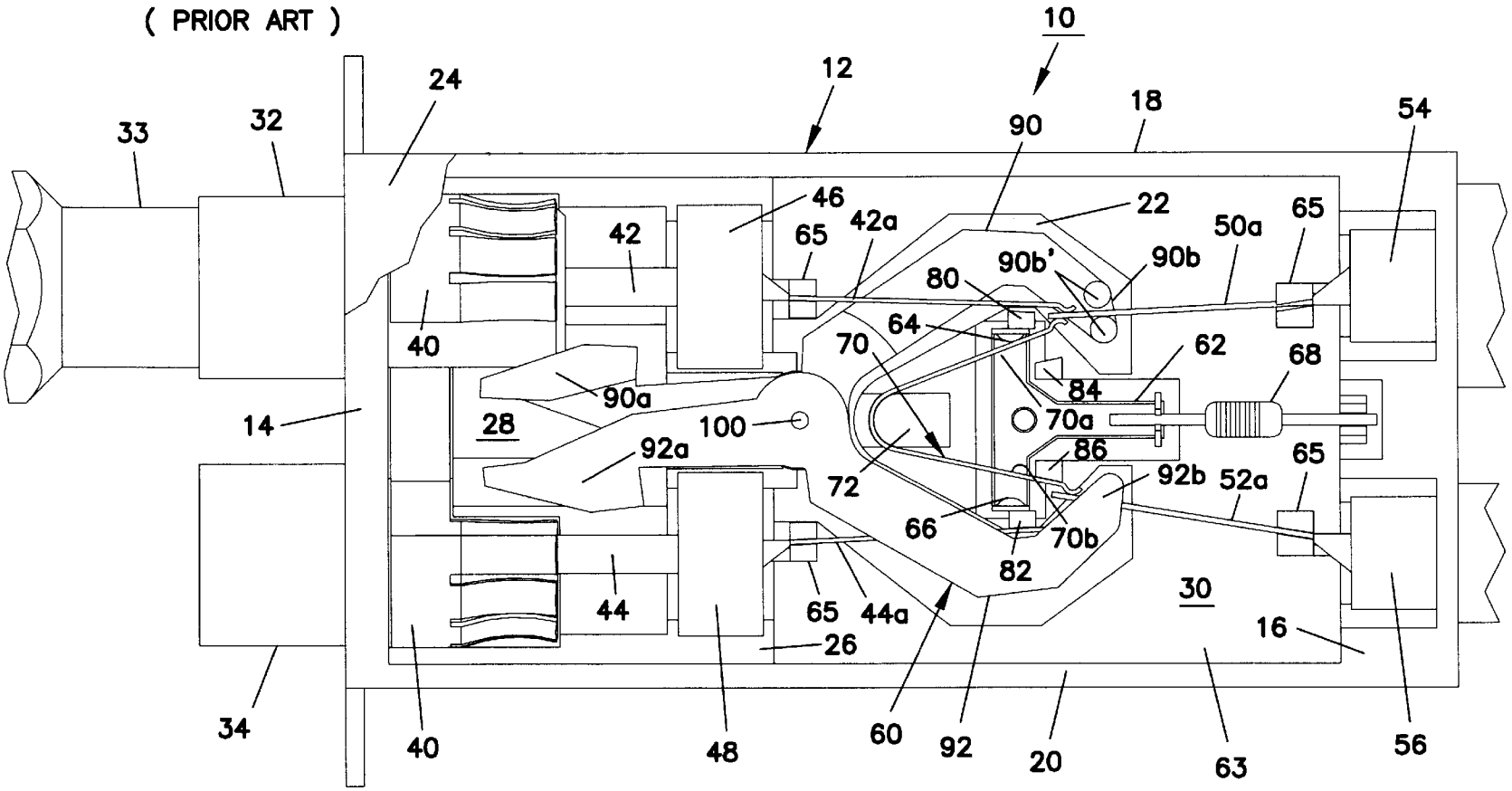
FIG. 3 ( PRIOR ART )
FIG. 3 is the view of FIGS. 1 and 2 with the plug shown still further inserted within the device.

FIGS. 2–4 show operation of the jack device 10 upon insertion of jack plug 33 into port 32. While operation with insertion of a jack plug into port 34 is not separately shown, it will be appreciated that it is identical to operation of insertion of the plug 33 into port 32.

As a plug 33 is inserted into port 32, the leading end of the plug sleeve engages the cam surface 90*a* causing it to be displaced. The displacement of the cam surface 90*a* causes reciprocating displacement of end 90*b*. As end 90*b* moves upwardly in the view of FIG. 2, the post 90*b*' urges spring 50*a* away from its biased position. As shown in FIG. 2, spring 50*a* electrically contacts spring 42*a* before V-spring end 70*a* contacts termination contact 64. Therefore, in this position, there is no grounding contact and springs 50*a*, 42*a* and 52*a* are electrically connected.

As spring 50*a* moves further upwardly in response to further insertion of plug 33 (FIG. 3), spring end 70*a* of the V-shaped spring 70 moves into contact with the first termination contact 64. It will be noted that when spring 70*a* is in electrical contact with first termination contact 64, the V-shaped spring end 70*a* and spring 50*a* are still in electrical and physical contact. Accordingly, contact through termination resistor 68 to ground is made before breakage of the signal path between spring 50*a* and spring 70. This sequence of operation is known as "make-before-break" sequencing. A make-before-break switching jack is disclosed in the aforementioned U.S. Pat. No. 4,749,968 to Burroughs.

Upon full insertion of the plug 33 into port 32 (FIG. 4), the free end of spring 50*a* remains in electrical and physical engagement with the free end of spring 42*a* and forces spring 42*a* upwardly from dielectric support 80. Since first termination contact 64 prevents further outward movement of spring 70*a*, electrical and physical connection between spring 70 and spring 50*a* is now broken. Further, the downward bias of spring 42*a* insures the continuous electrical and physical contact between the free ends of springs 42*a* and 50*a*. By capturing the movable spring 50*a* between the posts 90*b*', the vibration which the jack 10 might be subject to during use is less likely to cause intermittent or other undesirable disconnection between spring 50*a* and its desired connection with either spring 70*a* or spring 42*a*.

As a result, the jack device 10 has the functional equivalence of the prior art jack devices. Mainly, with the absence of a plug into either of ports 32, 34, electrical connection between rear center conductors 50, 52 is maintained. Upon insertion of a jack plug into either of the jack ports, the electrical connection between rear center conductors 50, 52 is broken and a new electrical connection is established from the rear center conductors 50, 52 to the front center conductors 42, 44. The other rear center conductor is terminated across resistance to an electrical ground.

The preferred jack device of FIGS. 1–15 has the further advantage that at no time is a substantial length of a center conductor extending off the signal path as was the case with the prior art. Namely, in the absence of a plug within port 32, the center conductor 42 and its associated spring portion 42*a* are disconnected electrically and physically from rear center conductor 50. Therefore at high frequency applications, the center conductor 42 and its spring portion 42*a* are not impairing the signal. Also, at all times, the spring switching chamber 30 is substantially sealed from the exterior of the housing 12. Therefore, passage of dust and other contaminants into the spring chamber 30 is resisted to minimize interference with the electrical connections within the spring chamber 30. Also, the dielectric supports 80, 82, 84, 86 and pins 90*b*', 92*b*' maintain desired electric contact or separation between the various springs at the no plug insertion mode (FIG. 1) and full plug insertion mode (FIG. 4) in the event of vibration forces acting on device 10.

In the foregoing description, the dielectric inserts 46, 48 were shown as being cylindrical bodies which were solid throughout their volume. While such a design is functional, the present invention will preferably utilize a reflective reducing design for a dielectric support. An example of such a support is shown in FIGS. 9–15 as dielectric insert 46*a*. The insert 46*a* provides the advantage that substantially all radial surfaces of the insert 46*a* are set at a non-orthogonal angle with respect to the longitudinal axis of the center conductors 42, 44.

With reference back to FIGS. 1 and 8, a cylindrical insert 46 having an axial face which is perpendicular to the axis of the center conductor 42 can result in unsatisfactory return loss in an electromagnetic signal traveling along a coaxial transmission line such as the center conductor 42. Namely, in a coaxial transmission line, an electromagnetic signal travels down the line between the center and outer conductors of a coaxial cable or between the center conductor 42 and the surrounding surfaces of the housing 12 which define an outer conductor surrounding the center conductor 42. The signal propagates through whatever dielectric medium is present between the center and outer conductors. For example, in a coaxial cable, the dielectric medium may be a plastic material positioned between the center conductor and an outer ground sleeve. Within a jack, the dielectric medium may be air filling a cavity between the center conductor 42 and opposing surfaces of the housing 12. As a result, different dielectric materials exist along the transmission line.

Every time a signal passes from one dielectric medium to another, a reflection is produced. An angle of incidence of a signal is the same as the angle of reflection. Therefore, if a signal impinges a dielectric boundary which is perpendicular to the direction of signal travel, a portion of the electromagnetic energy will be reflected straight back in the opposite direction.

With cylindrical configurations such as inserts 46, 48, two surfaces are provided on opposite axial ends of the inserts 46, 48 which are perpendicular to the direction of signal travel. Therefore, such an insert produces two reflections traveling down the transmission line toward a source.

Other prior art insulators have a combination of a solid dielectric material and air gaps to provide a composite effect of two dielectric coefficients in order to yield a specific impedance. Such insulators may have radially extending vanes extending from a hub. However, the vanes typically present surfaces which are perpendicular to the direction of the signal travel. Also, such insulators which include air gaps may also have a thin membrane of dielectric material which is perpendicular to the direction of signal travel in order to reasonably seal a device from dust or other contaminants. Such a membrane usually results in a significant impedance mismatch (i.e., an impedance other than that of the rest of the transmission line) over the small thickness of the membrane. An impedance mismatch is undesirable since such a mismatch is another source of reflection and also presents a signal power loss.

The preferred insert 46*a* includes a cylindrical outer wall 111 having a cylindrical outer surface 110 sized to be received within the housing in wall 26 in the same manner as inserts 46, 48. The insert 46*a* includes a central hub 112 having an axially extending bore 114 to snugly receive the center conductor 42. The hub 112 is conical in configuration and is supported by a plurality of radially extended ribs 116 extending between the conical hub 112 and an inner surface of the outer cylindrical wall 111.

Figure 10:
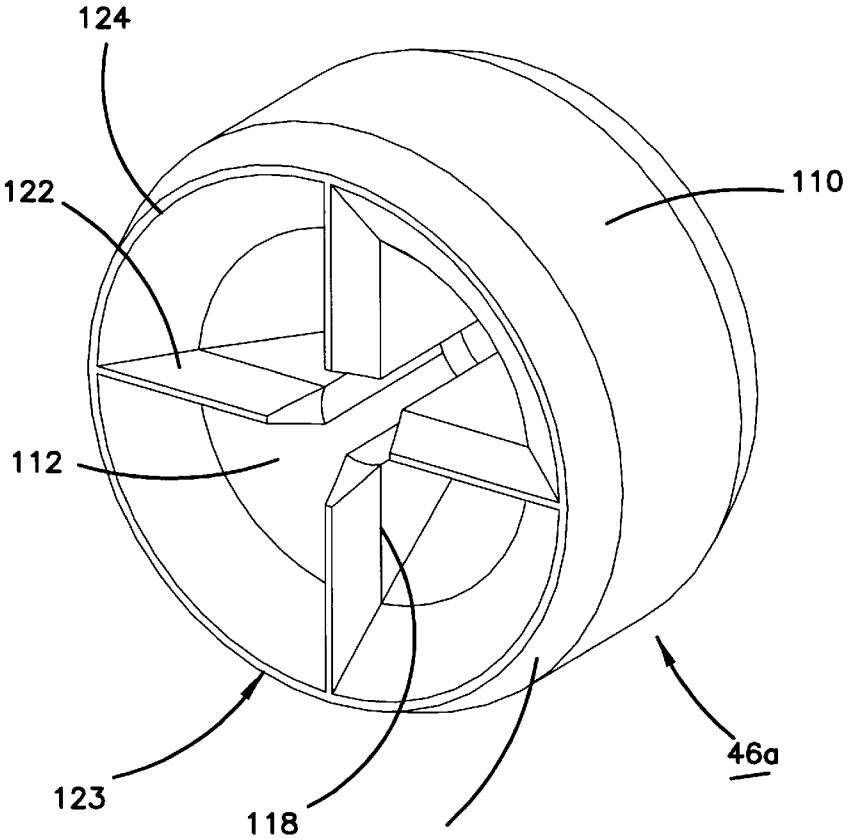
FIG. 10 ( PRIOR ART )
FIG. 10 is rear perspective view of the insert of FIG. 9.
Figure 9:
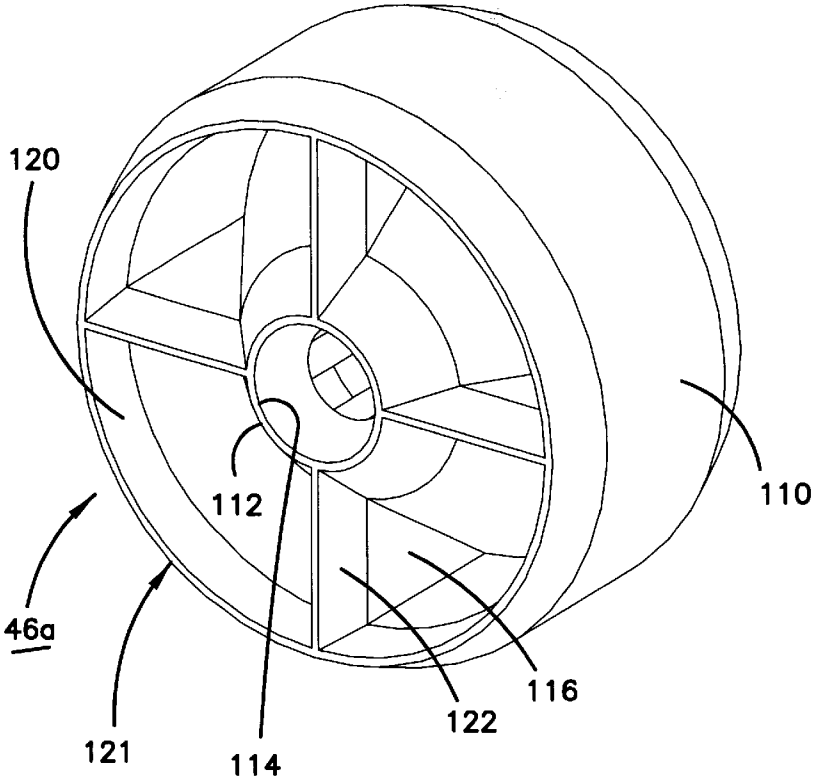
FIG. 9 ( PRIOR ART )
FIG. 9 is a front perspective view of a novel dielectric insert for holding a center conductor.
Figures 11, 13, 14:
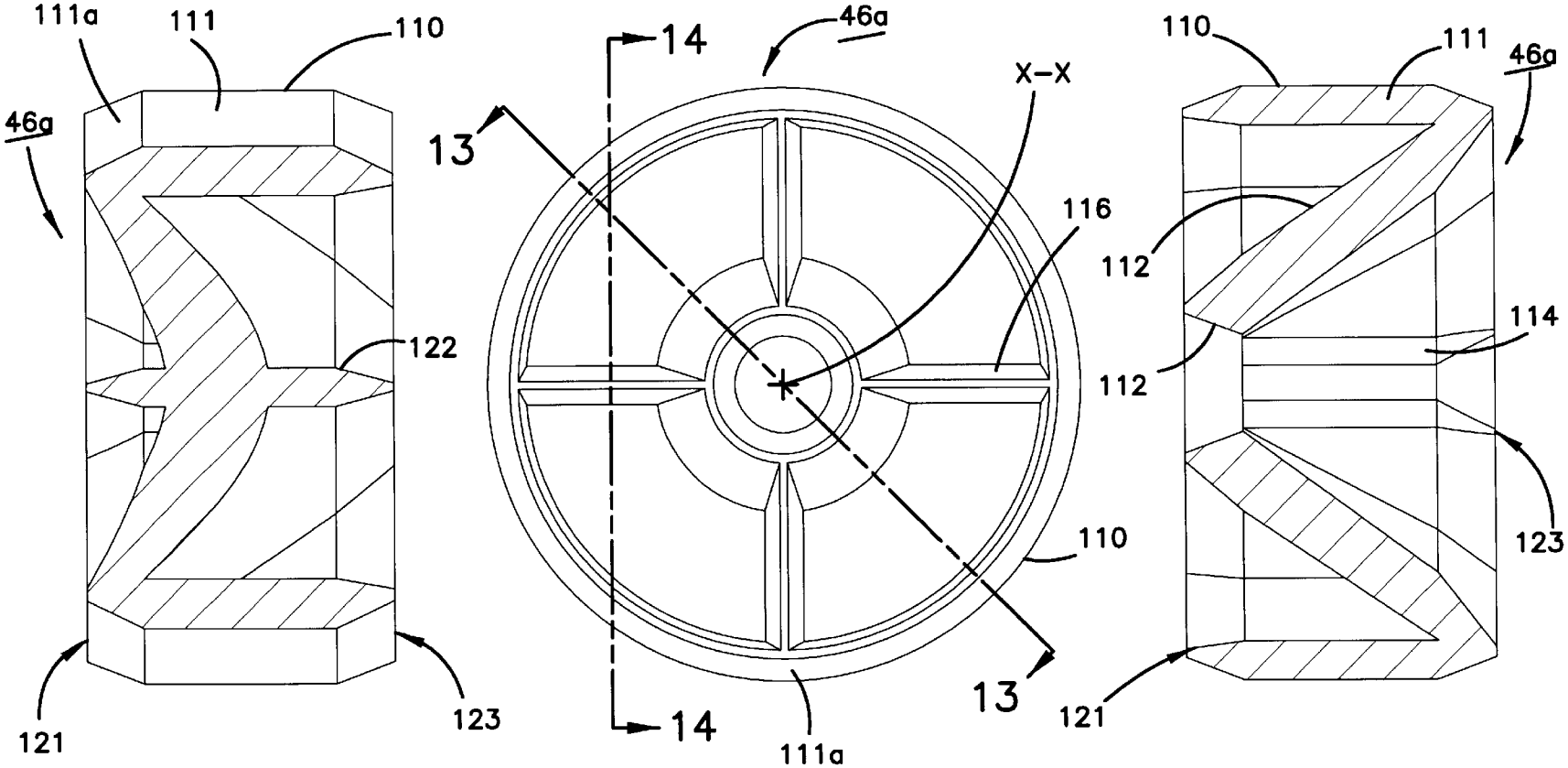
FIG. 13 ( PRIOR ART )
FIG. 11 ( PRIOR ART )
FIG. 14 ( PRIOR ART )
FIG. 11 is a front plan view of the insert of FIG. 9.
FIG. 13 is a view taken along lines 13—13 of FIG. 11.
FIG. 14 is a view taken along line 14—14 of FIG. 11.
Figure 15:
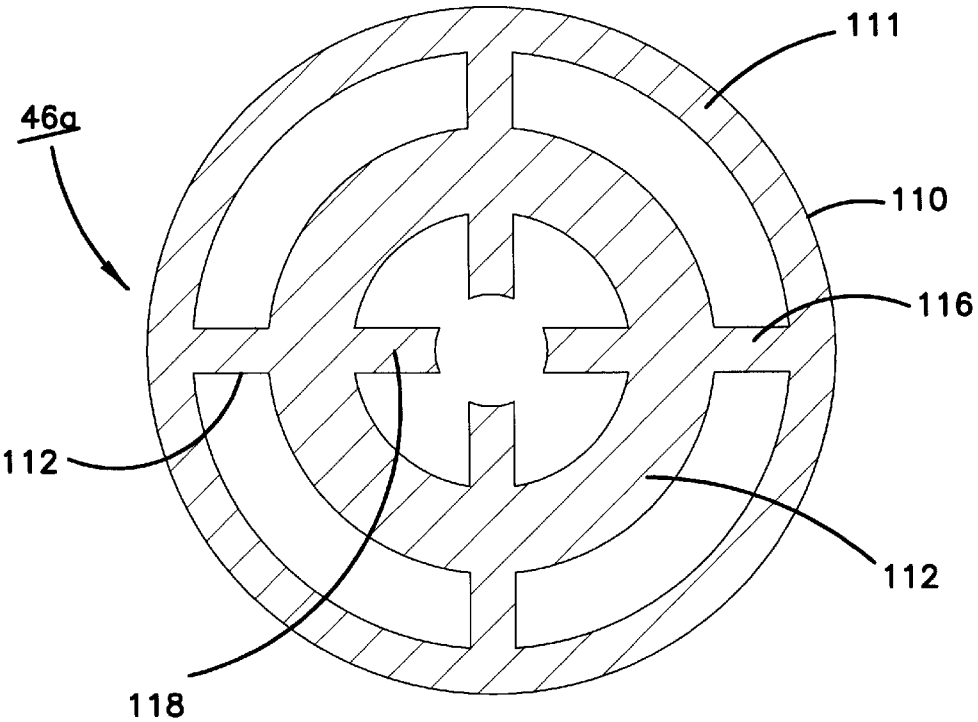
FIG. 15 ( PRIOR ART )
FIG. 15 is a view taken along line 15—15 of FIG. 12.
Figure 12:
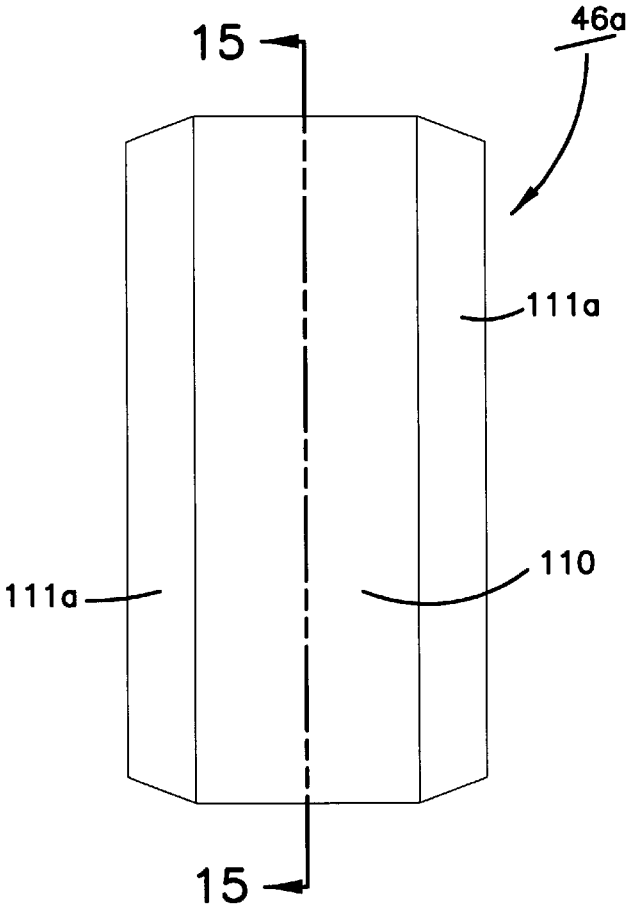
FIG. 12 ( PRIOR ART )
FIG. 12 is a side elevation view of the insert of FIG. 9.
Figure 16:
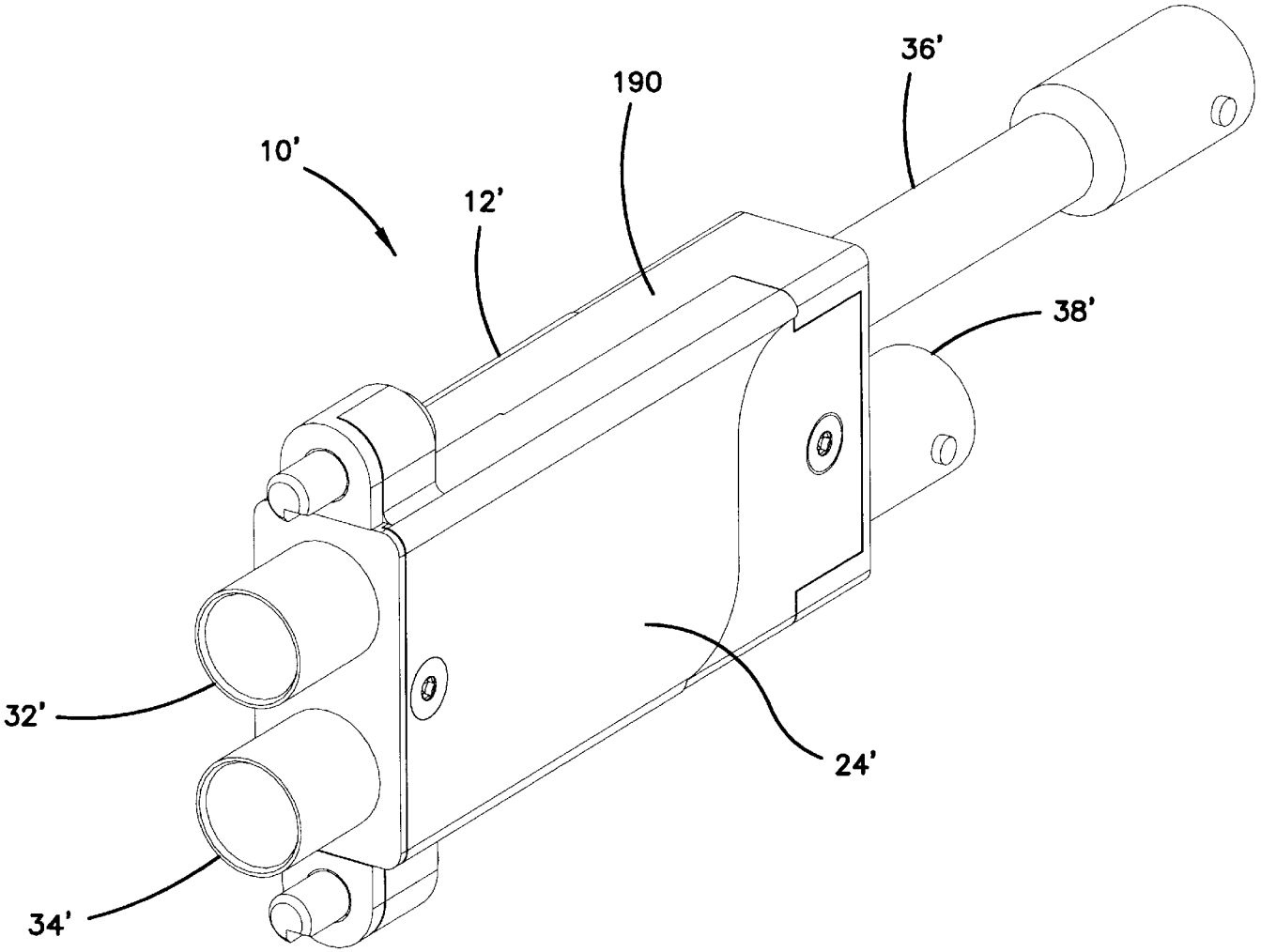
FIG. 16 is a perspective view of a switching coaxial jack device like the switching jack device of FIG. 1 with internal waveguides.
Figure 17:
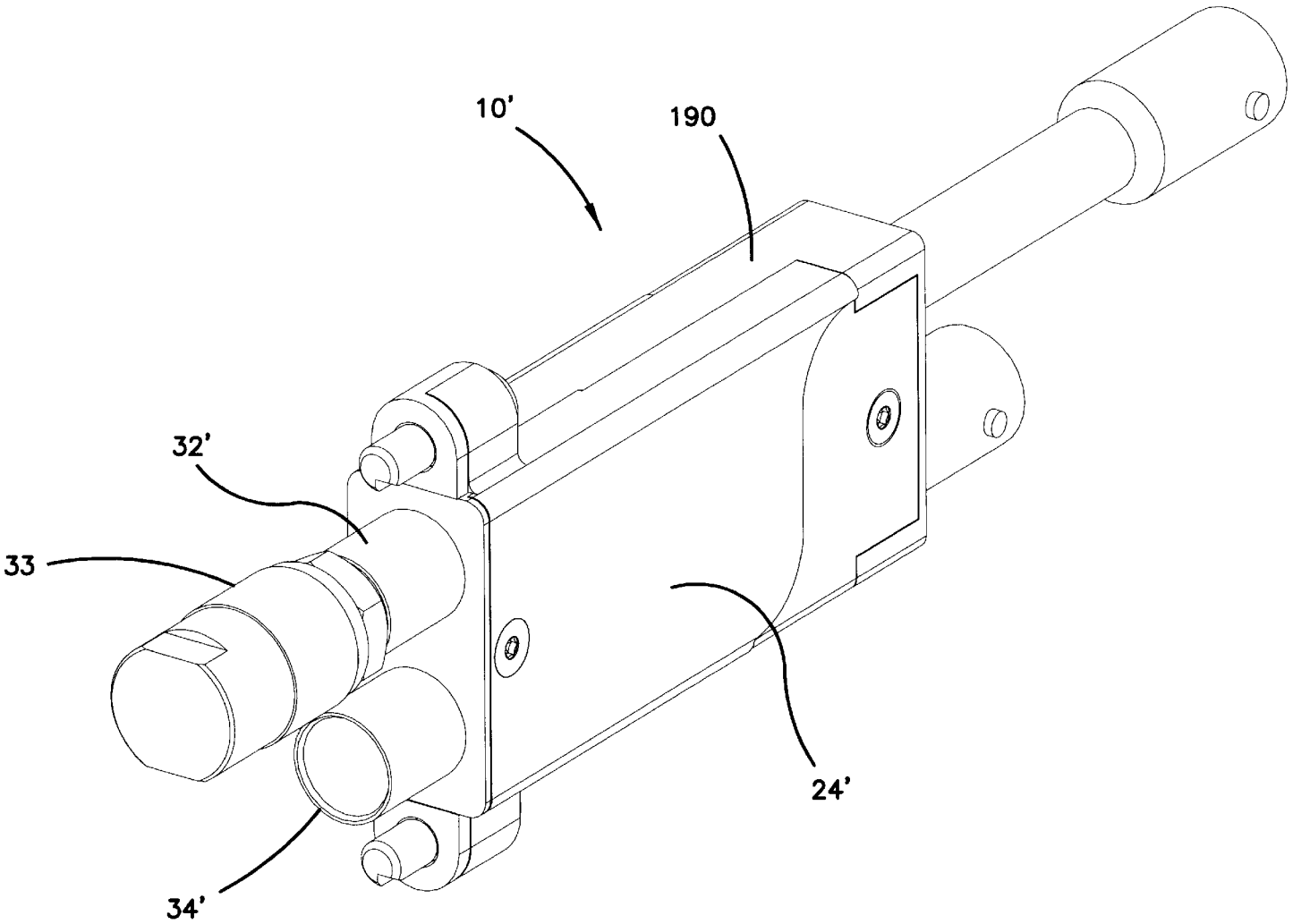
FIG. 17 is a perspective view of the jack device of FIG. 16 shown with a plug inserted within a forward port of the jack device.
Figure 18:
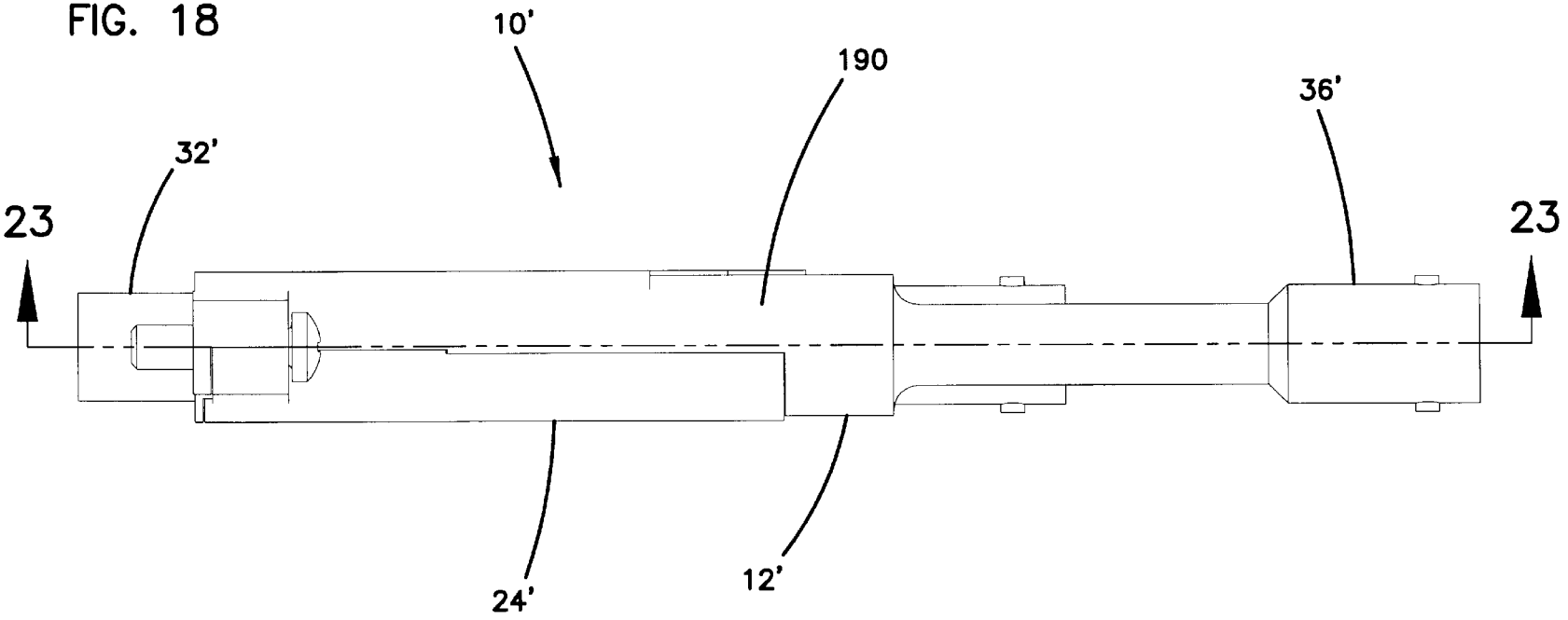
FIG. 18 is a top view of the jack device of FIG. 16.
Figure 19:
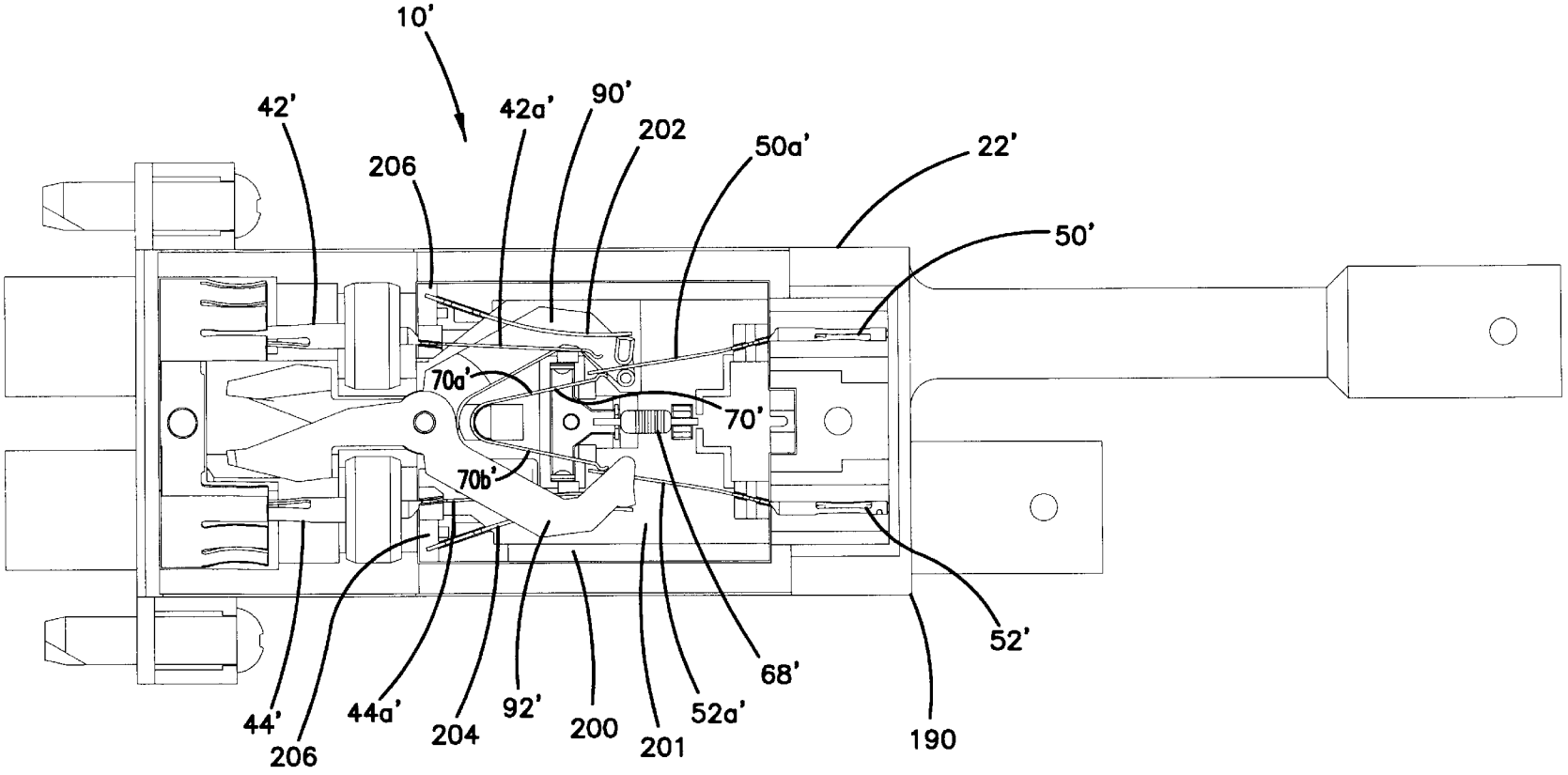
FIG. 19 is a side view of the jack device of FIG. 16, shown with the cover removed.
Figure 20:
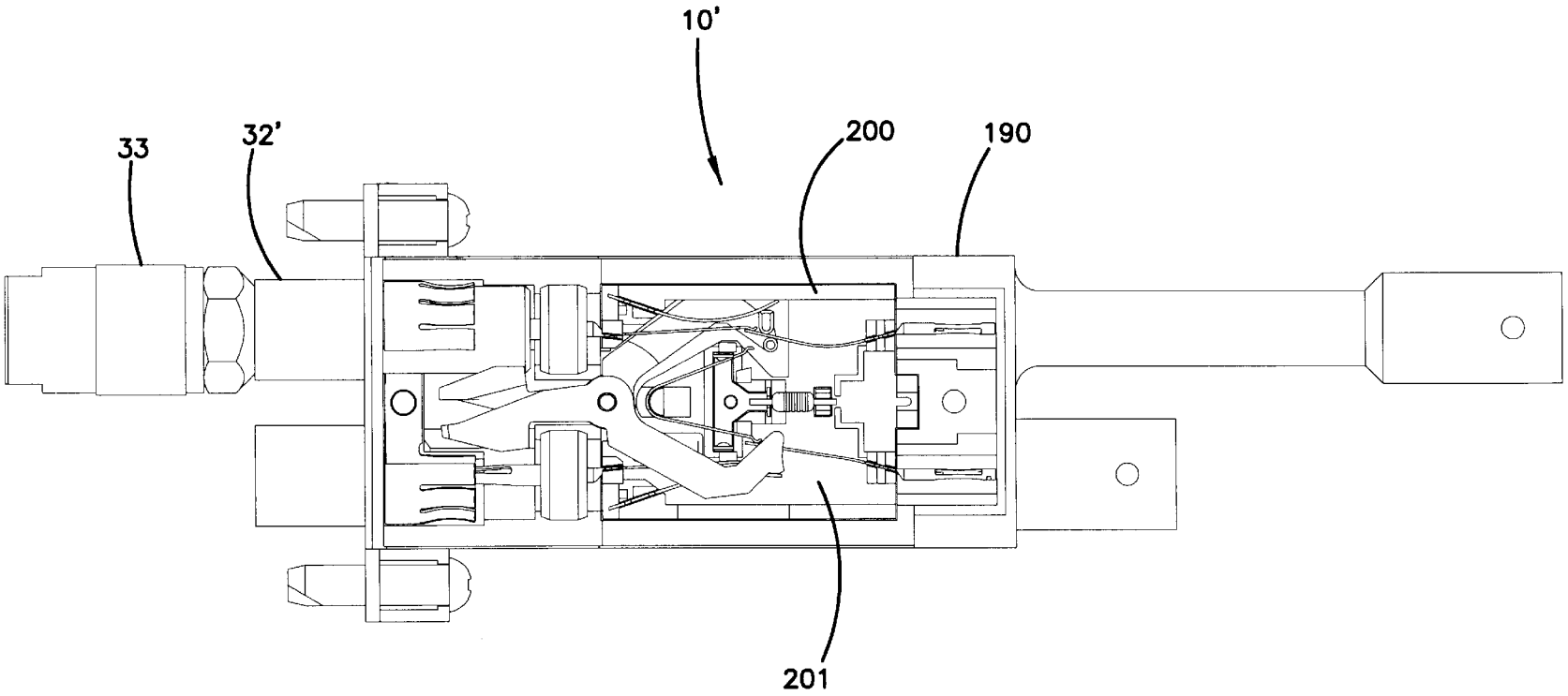
FIG. 20 is a side view of the jack device of FIG. 16, shown with the cover removed and a plug inserted within a forward port of the jack device.
Figure 21:
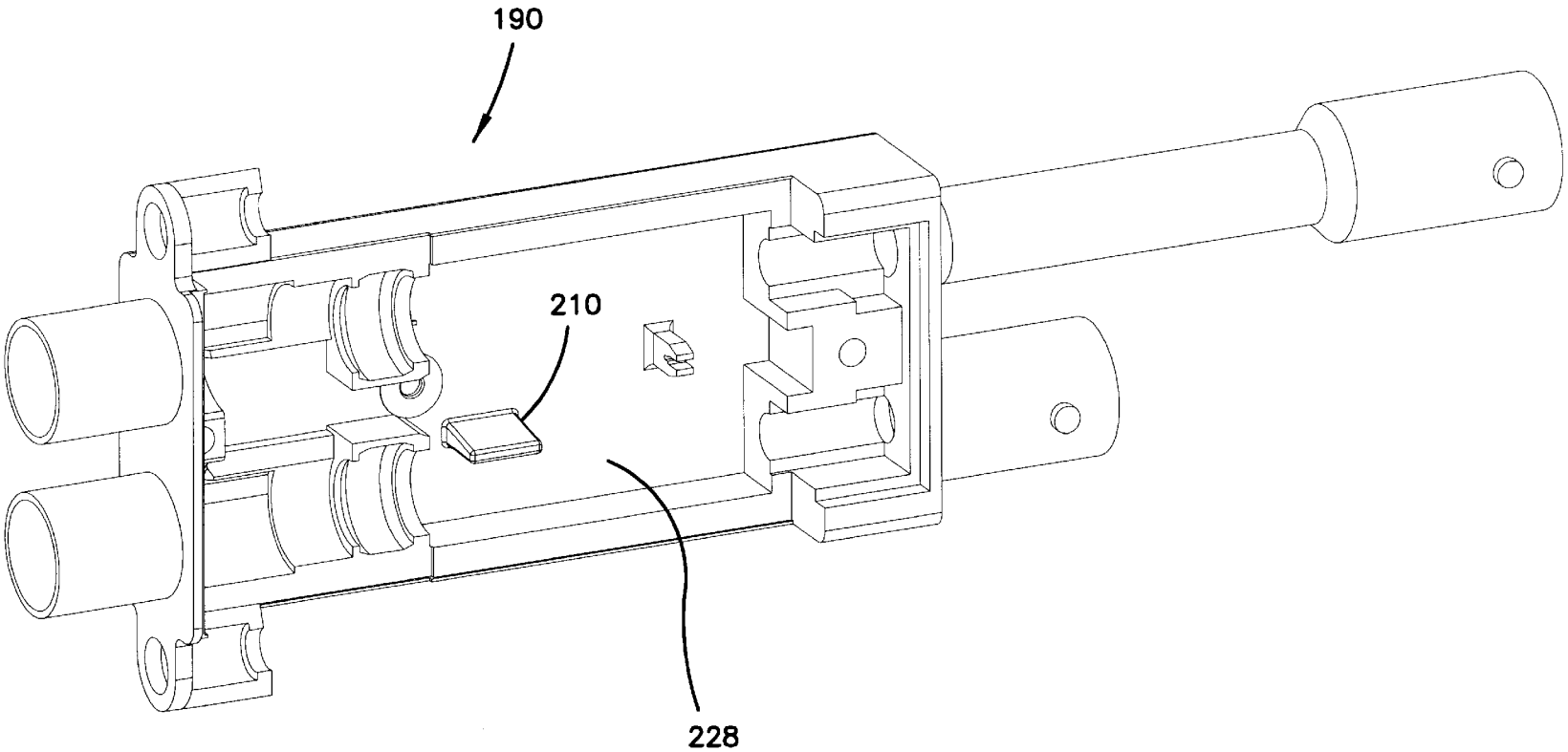
FIG. 21 is a perspective view of the main housing of the jack device of FIG. 16.

A first axial face 121 of the insert 46*a* is shown in FIG. 9. A reverse axial face 123 is shown in FIG. 10. The reverse side 123 further includes a plurality of radially extending ribs 118 supporting the conical hub 112. The ribs 118 have opposing interior surfaces spaced apart to further define the bore 114. The axial edges of the outer cylindrical body 111 are tapered to provide bevel faces 120. Similarly, the edges of all the ribs 116, 118 are tapered to provided beveled faces 122. Accordingly, substantially none of the surface area of either the first or second axial ends 121, 123 is perpendicular to the axis X—X of the insert 46*a*. By substantially, it will be appreciated that sharp knife edges on the tapered face 120,122 cannot be achieved in most molding processes. Accordingly, small blunt areas 124 may result from limitations in manufacturing processes. It is the intent of the present invention that such surface areas be minimized as far as practical through manufacturing processes.

With the embodiment shown in FIGS. 9–15 the entire axial face 121, 123 of the insert 46*a* on both sides of the insert 46*a* presents a non-orthogonal surface relative to the path of travel of the electromagnetic signal approaching the insert 46*a*. As a result, the signal is not reflected axially away from the insert 46*a* thereby reducing back reflection. While the conical surface 112 can be curved, it would be preferred that the conical surface be flat since a curved surface can reflect a signal in many different directions. However, curvature can be acceptable in order to obtain desired impedance matching at every cross section along the axial length of the insert 46*a*.

Jack device 10 including the switching feature and the other features described above and shown in FIGS. 1–15 provides an advantageous device suitable for many uses. One use where modifications to device 10 become advantageous is for applications that are running the SMPTE292M 1.5 GBits/s HDTV uncompressed signal. In the uncompressed format, this signal requires 2.4 gigahertz of bandwidth. The electrical performance of jack device 10 is altered through impedance matching to allow use at higher frequencies. Specifically, material is added to selected locations within jack housing 12 to keep the characteristic impedance of the jack device at or within an acceptable range of 75 ohms through the desired bandwidth, such as 2.4 gigahertz. U.S. Pat. No. 5,467,062 provides a detailed discussion of impedance matching in a jack module 10 of the '062 patent. The disclosure of U.S. Pat. No. 5,467,062 is hereby incorporated by reference. Generally, jack device 10 of FIGS. 1–5 can be tuned with the addition of waveguides to allow usage at increased bandwidths.

Preferred jack device 10' shown in FIGS. 16–24 includes a housing 12' with main housing 190, and a removable side cover 24' held by fasteners 192. Front ports 32' and 34' are provided. Rear connectors 36' and 38' are also provided. Disposed within housing 12' is a similar switch as described above for jack device 10. One notable difference is the use of a single dielectric member 200 including a plate portion 201 including dielectric projections 65' which supports each of springs 42*a*', 50*a*', 44*a*', and 52*a*', and support post 72' which supports spring 70'. Also, supplemental springs 202, 204 are provided to urge levers 90', 92' to the positions shown in FIGS. 19 and 23. Springs 202, 204 are held by dielectric supports 206, 207 of dielectric member 200.

A primary difference between jack device 10' and jack device 10 is the inclusion of a plurality of waveguides 210, 212, 214, 216, 218, 220, and 222. Waveguide 210 is positioned on main housing 190 and projects to be adjacent to spring 44*a*'. Waveguides 212, 214, 216, 218, and 220 project from cover 24' toward main housing 22'. Waveguide 212 is positioned adjacent to spring 42*a*'. Waveguides 214, 216 are positioned on opposite sides of spring 50*a*'. Waveguides 218, 220 are positioned on opposite sides of spring 52*a*'. Waveguide 222 is positioned between legs 70*a*', 70*b*' of spring 70'.

Waveguide 218 is slightly shorter in its length projecting from wall portion 226 than waveguides 214, 216, and 220. For this reason, waveguide 218 is not visible in the cross-sectional view of FIGS. 23 and 24. Waveguide 222 also is not tall enough to be visible in the cross-sectional views of FIGS. 23 and 24. Generally, each waveguide 210, 212 through 220, and 222 extends from a planar wall portion 228 and 226, respectively, of housing 12'. Also, each waveguide defines a generally planar surface facing at least partially toward each leaf spring member in the preferred embodiment. The preferred waveguides are provided as small fins (210–220), or platforms (222), allowing housing 12' to be made form die cast metal with integrally molded waveguides. Therefore, preferred housing 12' is a two piece die cast construction with the various waveguides formed integrally therewith.

Figure 22:
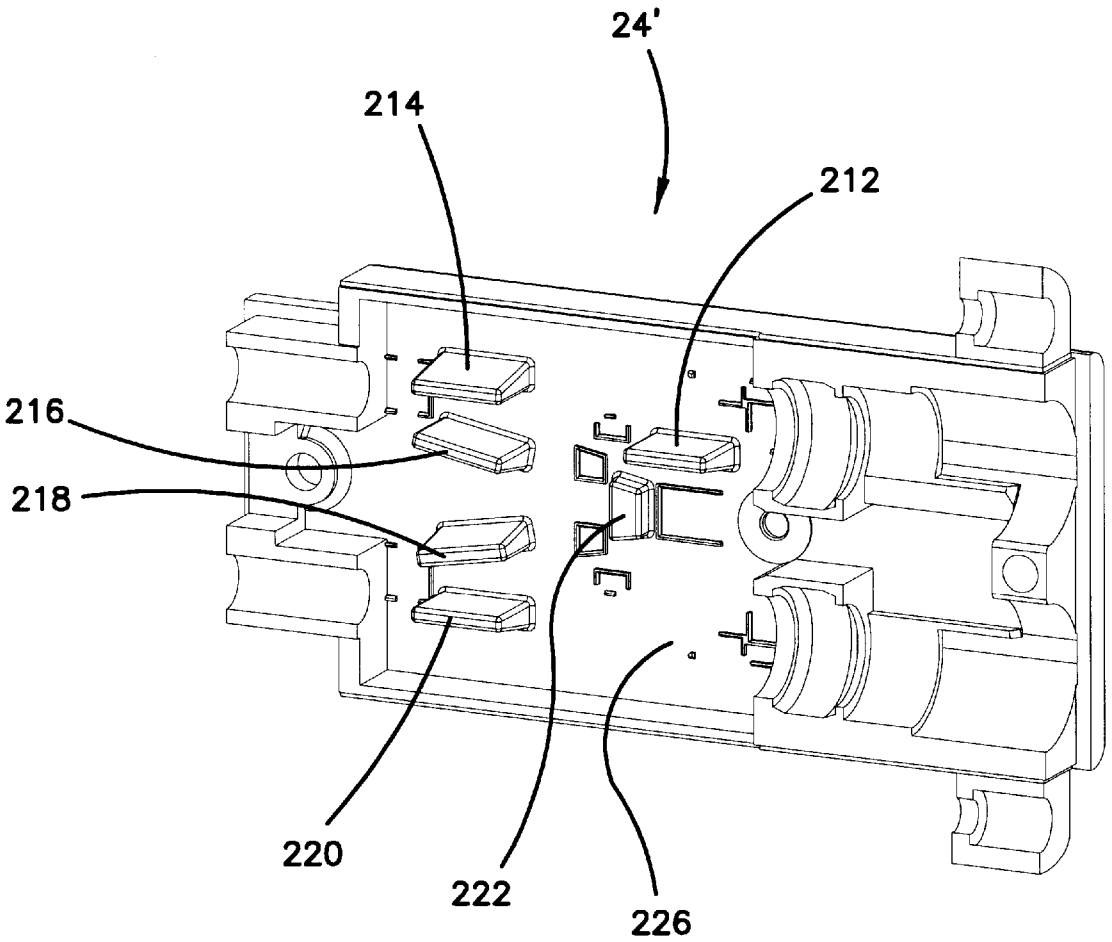
FIG. 22 is a perspective view of the cover of the jack device of FIG. 16.
Figure 23:
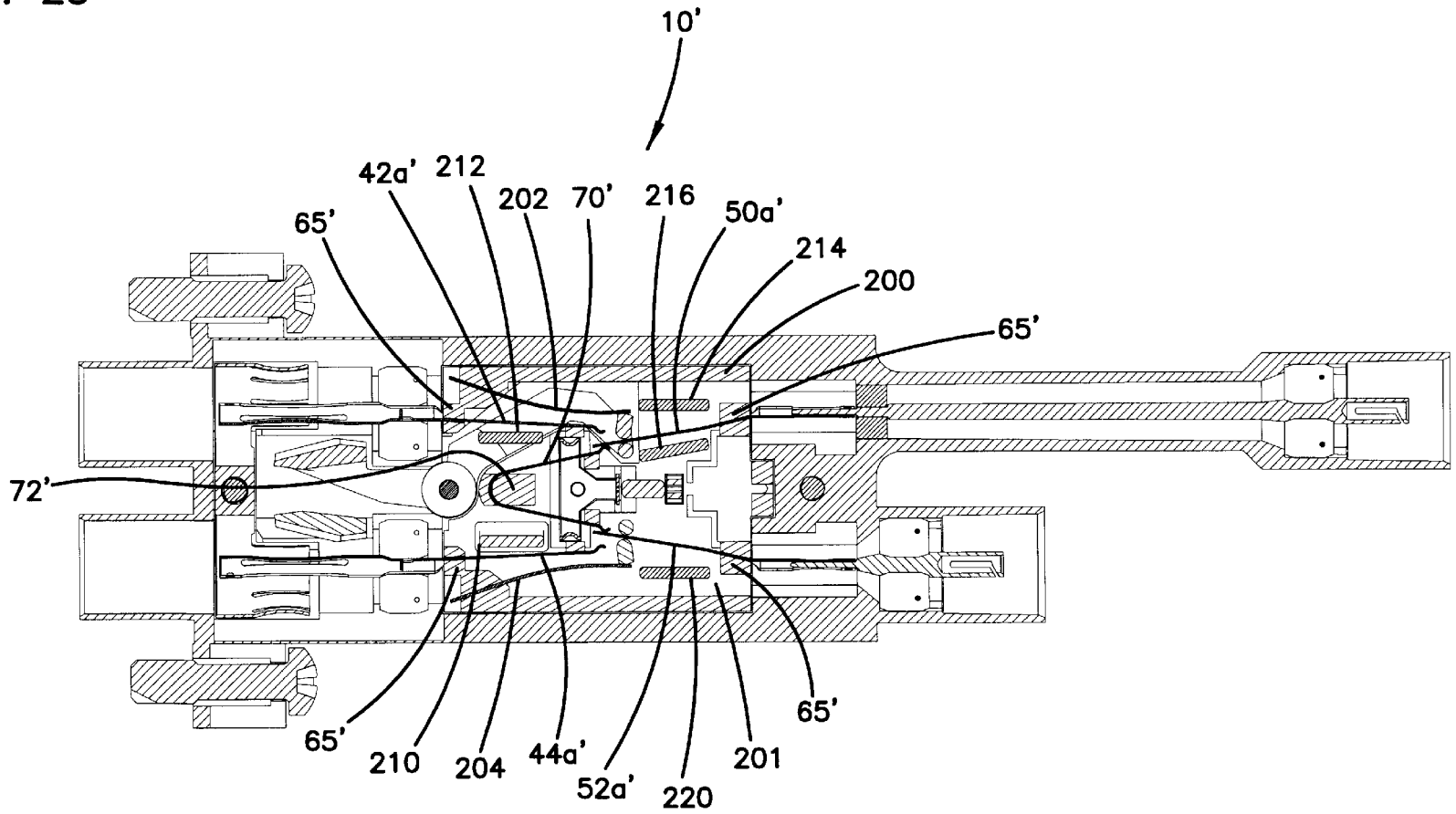
FIG. 23 is a cross-sectional side view of the jack device of FIG. 16 taken along lines 23—23 of FIG. 18.
Figure 24:
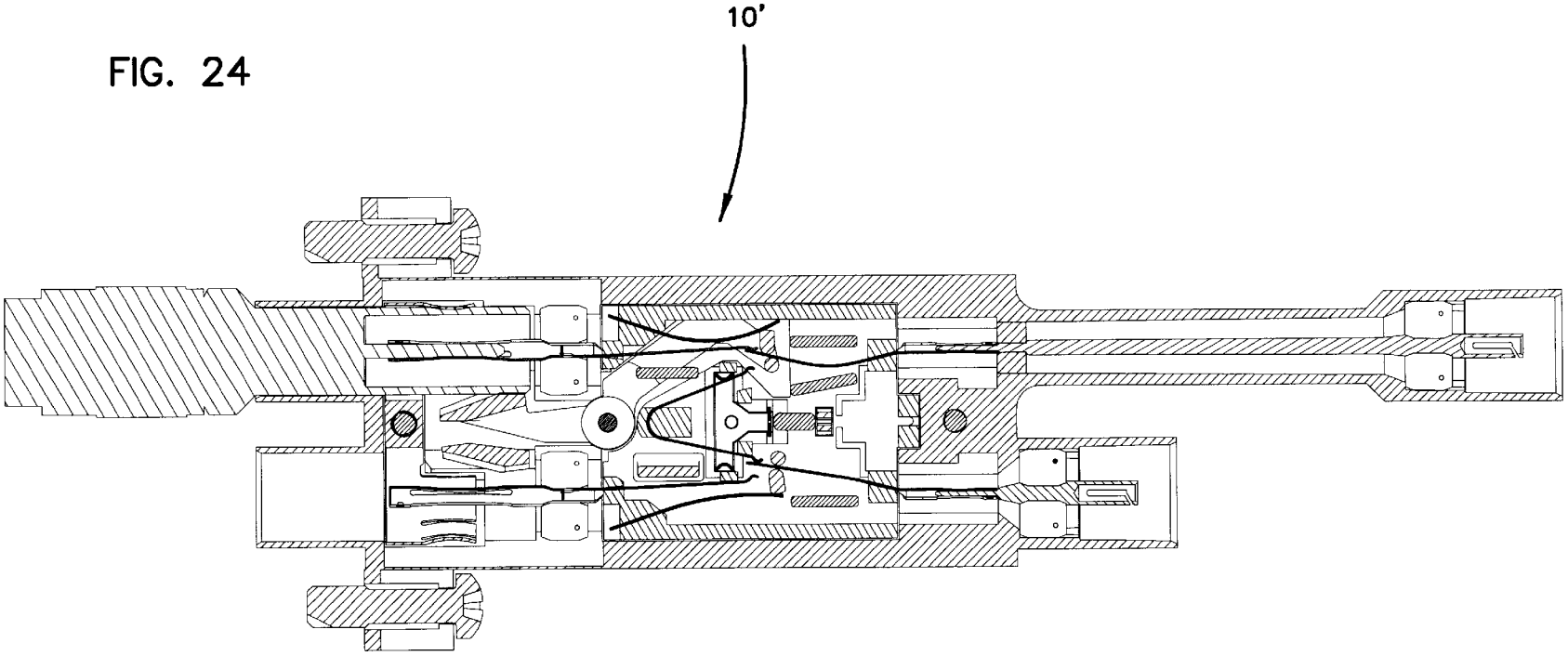
FIG. 24 is a cross-sectional side view of the jack device of FIG. 16, shown with a plug inserted into a forward port of the jack device.

As shown best in FIGS. 22–24, waveguides 210 through 222 are suitably positioned in housing 12' so as to not interfere with or contact any of the moveable springs 42*a*', 44*a*', 50*a*', 52*a*' or 70' during use of jack device 10'.

Referring now to FIGS. 25 and 26, performance curves are shown for characteristic impedance and return loss for jack device 10 (A curves) and jack device 10' (B curves). As the graphs indicate, impedance with the waveguides present remains within the preferred range of ±10 ohms through 2400 megahertz (2.4 gigahertz). This is an improvement over jack device 10 which drops out of the preferred range at about 750 megahertz. Similarly, with respect to return loss, jack device 10' exceeds 2400 megahertz (2.4 gigahertz) with the return loss at or less than about 20 decibels. Jack device 10 sees approximately a 20 decibel loss at or about 750 megahertz.

Through the use of waveguides such as waveguides 210 through 222, impedance matching is achieved. Additional waveguides or alternative shapes and sizes to the waveguides are possible in order to achieve impedance matching so as to meet or exceed the desired bandwidth, i.e. 2.4 gigahertz bandwidth in this embodiment, while still maintaining a characteristic impedance of 75 ohms±the acceptable range of ohms.

Having described the present invention in a preferred embodiment, it will be appreciated that modifications and equivalents of the disclosed concepts may readily occur to one skilled in the art. For example, while the preferred embodiment is shown with two forward ports 32, 32', and 34, 34', it will be appreciated that only one forward port 32, 32' may be required. Also, as is conventional, a monitoring circuit or monitoring jack may be connected to jack 10' to permit non-intrusive monitoring of a signal. It will be appreciated that such monitoring jacks and connection of monitoring jacks to switching coaxial jacks is well know. An example of such is shown in U.S. Pat. Nos. 4,749,968 and 5,467,062 to Burroughs.

Other switches besides the preferred switch within jack devices 10, 10' are possible where electrical performance can be improved for increased bandwidth through the use of waveguides extending from an outer grounded housing adjacent to internal conductive components. Adding waveguides to previously empty spaces within a coaxial switching jack can extend the bandwidth of the device to higher ranges. Forming the waveguides as extensions of the housing into the empty spaces allows for an advantageous jack device. Through the use of spectrum analyzers such as described in U.S. Pat. No. 5,467,062 appropriate waveguides (sizes, shapes, and positions) can be selected to alter the electrical performance of the jack to achieve higher bandwidths. As noted above and shown in the drawings, particular advantages are seen by adding such waveguides to housings having generally planar sidewalls, and switches having moveable members, such as moveable leaf springs.

Finally, center conductors 42, 42' and 44, 44' are shown solid in the drawings. For ease of manufacture, such conductors can be formed of a stamping and rolling process to produce a hollow, tubular conductor. To resist dust migration, conductor so formed will preferably have a detent or inwardly protruding tab to present a blocking surface to dust which would otherwise pass through the hollow center conductor.

What is claimed is:

1. A switching coaxial jack device comprising:

an electrically grounded housing having a rear end, a front end, a top wall, a bottom wall, and two side walls defining generally planar surfaces facing one another, wherein said front and rear ends, and said top, bottom and side walls form an enclosed housing;

said front end having at least a first jack port for slidably receiving a plug having a center pin connected to an attached coaxial cable, a first front center conductor disposed within said first jack port to receive said center pin upon insertion of said plug within said first jack port;

said rear end having at least a first rear coaxial connector and a second rear coaxial connector each having first and second, respectively, rear center conductors for connection with center conductors of coaxial conductors connected to respective ones of said first and second coaxial connectors;

a first electrically terminated contact within said housing;

a switch within said housing for electrically connecting said first and second rear center conductors when no plug is received in said first jack port, said switch electrically disconnecting said first and second rear center conductors when said plug is received in said first jack plug, wherein said first rear center conductor becomes electrically connected to said front center conductor, and wherein said second rear center conductor becomes electrically connected to said terminated contact, said switch including at least one conductive movable portion defining a leaf spring portion;

said housing including a waveguide projecting from one of said side walls adjacent to said moveable portion, said waveguide including a planar portion facing said leaf spring portion.

2. A coaxial jack device according to claim 1 wherein said switch includes a V-shaped spring with two moveable arms, said front end having a second jack port for slidably receiving a plug having a center pin connected to an attached coaxial cable, a second front center conductor disposed within said second jack port to receive said center pin upon insertion of said plug within said second jack port.

3. A coaxial jack device according to claim 2 wherein said switch includes a second moveable portion projecting from said first rear center conductor and engageable with one of said moveable arms of said V-shaped spring, wherein said switch further includes a third moveable portion projecting from said second rear center conductor and engageable with the other of said moveable arms of said V-shaped spring, and further comprising second and third waveguides projecting from one of said side walls adjacent to said second and third moveable portions, respectively, each of said second and third moveable portions defining a leaf spring portion, each of said second and third waveguides defining a planar portion facing said leaf spring portions, respectively, of said second and third moveable portions.

4. A coaxial jack device according to claim 3 wherein said switch includes a fourth moveable portion projecting from said front center conductor and engageable with said second moveable portion of said first rear center conductor when said second moveable portion is not engaged with said V-shaped spring, and further comprising a fourth waveguide projecting from one of said side walls adjacent to said fourth moveable portion, said fourth moveable portion defining a leaf spring portion, said fourth waveguide defining a planar portion facing said leaf spring portion of said fourth moveable portion.

5. A switching coaxial jack device comprising:

a first electrically conductive coaxial center conductor having a front portion and rear portion;

a second electrically conductive coaxial center conductor;

both of said front portion and said rear portion including front and rear, respectively, fixed position attachment ends for attachment to a coaxial conductor;

said second center conductor having a fixed position attachment end for attachment to a coaxial conductor;

said rear portion including an electrically conductive movable portion which is movable between a first position and a second position while maintaining electrical connection with said rear attachment end;

said movable portion disposed in electrical contact with said second center conductor and electrically disconnected from said front portion when said movable portion is in said first position;

said movable portion disposed in electrical contact with said front portion and electrically disconnected from said second center conductor when said movable portion is in said second position;

an actuator for moving said movable portion from said first position to said second position when a coaxial cable is attached to said front attachment end; and an electrically grounded housing surrounding said first and second center conductors, said housing including a waveguide extending toward said movable portion.

6. A coaxial jack device according to claim 5 comprising termination means for electrically terminating said second center conductor through a resistance to ground when said movable portion is in said second position.

7. A coaxial jack device according to claim 6 wherein said termination means includes an electrically terminated contact;

an electrically conductive switch spring in electrical contact with said second conductor, said switch spring biased into electrical contact with said terminated contact and electrically disconnected from said movable portion when said movable portion is in said second position;

said movable portion positioned to be electrically connected with said second center conductor through said switch spring with said movable portion electrically engaging said switch spring as said movable portion is moved toward said first position and said switch spring urged away from said terminated contact by said movable portion moving to said first position.

8. A coaxial jack device according to claim 7 wherein said terminated contact, said switch spring, said front portion and said movable portion are mutually positioned for said switch spring to electrically engage said terminated contact before said switch spring separates from said movable portion as said movable portion is moved to said second position.

9. A coaxial jack device according to claim 7 wherein said movable portion is a first spring biased into electrical contact with said switch spring at said first position.

10. A coaxial jack device according to claim 9 wherein said front portion of said first center conductor includes a second spring with said first spring engaging said second spring and displacing said second spring against its bias as said first spring is moved to said second position.

11. A coaxial jack device according to claim 5 wherein said actuator includes a lever having a cam end positioned to be displaced in response to said coaxial cable being connected to said front attachment end;

said lever having a second end disposed to urge said movable portion to said second position in response to displacement of said cam end.

12. A coaxial jack device according to claim 11 wherein said second end of said lever includes means for restraining said movable portion from movement relative to said second end.

13. A switching coaxial jack device comprising:

an electrically grounded housing having a rear end, a front end and sidewalls;

said front end having at least a first jack port for slidably receiving a plug having a center pin connected to an attached coaxial cable, a first front center conductor disposed within said first jack port to receive said center pin upon insertion of said plug within said first jack port;

said rear end having at least a first rear coaxial connector and a second rear coaxial connector each having first and second, respectively, rear center conductors for connection with center conductors of coaxial conductors connected to respective ones of said first and second coaxial connectors;

a first electrically terminated contact;

an electrically conductive switch spring in electrical contact with said second rear center conductor, said switch spring having a first end biased into electrical contact with said terminated contact;

said first rear center conductor including an electrically conductive first movable portion which is movable between a first position and a second position;

said first movable portion positioned to electrically engage said first end of said switch spring as said first movable portion is moved toward a first position and said switch spring urged away from said terminated contact by said first movable portion moving to said first position;

said first movable portion disposed in electrical contact with said first front center conductor and electrically disconnected from said first end of said switch spring when said movable portion is in a second position;

a first lever having a cam end positioned to be displaced in response to said plug inserted within said first front port;

said lever having a second end disposed to urge said first movable portion to said second position in response to displacement of said cam end; and a waveguide extending from one of said sidewalls and positioned adjacent to said moveable portion.

14. A switching coaxial jack device according to claim 13 comprising:

a second jack port for slidably receiving a plug having a center pin connected to an attached coaxial cable, a second front center conductor disposed within said second jack port to receive said center pin upon insertion of said plug within said second jack port;

a second electrically terminated contact;

said switch spring having a second end biased into electrical contact with said second terminated contact;

said second rear center conductor including an electrically conductive second movable portion which is movable between a first position and a second position;

said second movable portion disposed in electrical contact with said switch spring second end and electrically disconnected from said second front center conductor when said second movable portion is in said first position;

said second movable portion positioned to electrically engage said switch spring second end as said second movable portion is moved toward a first position and said switch spring second end urged away from said second terminated contact by said second movable portion moving to said first position;

said second movable portion disposed in electrical contact with said second front center conductor and electrically disconnected from said switch spring second end when said second movable portion is in a second position;

a second lever having a cam end positioned to be displaced in response to said plug inserted within said second front port;

said second lever having a second end disposed to urge said second movable portion to said second position in response to displacement of said cam end; and a second waveguide extending from one of said sidewalls and positioned adjacent to said second moveable portion.

15. A switching coaxial jack device according to claim 14 comprising a third waveguide positioned between said first and second ends of said switch spring.

16. A switching coaxial jack device for use in a telecommunications line having a characteristic impedance comprising:

an electrically grounded housing having a rear end, a front end, a top wall, a bottom wall, and two side walls defining generally planar surfaces facing one another, wherein said front and rear ends, and said top, bottom and side walls form an enclosed housing;

said front end having at least a first jack port for slidably receiving a plug having a center pin connected to an attached coaxial cable, a first front center conductor disposed within said first jack port to receive said center pin upon insertion of said plug within said first jack port;

said rear end having at least a first rear coaxial connector and a second rear coaxial connector each having first and second, respectively, rear center conductors for connection with center conductors of coaxial conductors connected to respective ones of said first and second coaxial connectors;

a first electrically terminated contact within said housing;

a switch within said housing for electrically connecting said first and second rear center conductors when no plug is received in said first jack port, said switch electrically disconnecting said first and second rear center conductors when said plug is received in said first jack plug, wherein said first rear center conductor becomes electrically connected to said front center conductor, and wherein said second rear center conductor becomes electrically connected to said terminated contact, said switch including a plurality of conductive movable portions;

said housing including a plurality of projections projecting from said side walls adjacent to said moveable portions wherein said projections are positioned to provide impedance matching of said coaxial jack device with said telecommunications line.

17. A coaxial jack device according to claim 16 wherein a plurality of said projections are fin-shaped, each having a planar portion facing one of said moveable portions of said switch.

18. A coaxial jack device according to claim 17 wherein said switch including said moveable portions includes a V-shaped spring with two moveable arms, said front end having a second jack port for slidably receiving a plug having a center pin connected to an attached coaxial cable, a second front center conductor disposed within said second jack port to receive said center pin upon insertion of said plug within said second jack port.

19. A coaxial jack device according to claim 18 wherein said switch includes one of said moveable portions projecting from said first rear center conductor and engageable with one of said moveable arms of said V-shaped spring, wherein said switch further includes another one of said moveable portions projecting from said second rear center conductor and engageable with the other of said moveable arms of said V-shaped spring.

20. A coaxial jack device according to claim 19 wherein a further one of said moveable portions projects from said front center conductor and engageable with said moveable portion of said first rear center conductor when said moveable portion is not engaged with said V-shaped spring.

21. A coaxial jack device according to claim 16 wherein said projections are positioned such that impedance through said jack device is within a range of ±10 ohms up to and including 2.4 gigahertz for a characteristic impedance of 75 ohms for said telecommunications line.

* * * * *

UNITED STATES PATENT AND TRADEMARK OFFICE

CERTIFICATE OF CORRECTION

PATENT NO. : 6,045,378

DATED : APRIL 4, 2000

INVENTOR(S) : FOLLINGSTAD

It is certified that error appears in the above-identified patent and that said Letters Patent is hereby corrected as shown below:

Col. 5, line 26: "th" should read --that dust cannot easily--

Col. 8, line 27: "FIGS. 1-5" should read --FIGS. 1-15--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*